US008413335B2

(12) United States Patent
Harris, II

(10) Patent No.: US 8,413,335 B2
(45) **Date of Patent: *Apr. 9, 2013**

(54) SCRUBBING RAZOR

(76) Inventor: John Robert Harris, II, Rancho Palos Verdes, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/294,809

(22) Filed: Nov. 11, 2011

(65) Prior Publication Data

US 2012/0055028 A1 Mar. 8, 2012

Related U.S. Application Data

(63) Continuation of application No. 12/908,868, filed on Oct. 20, 2010, now Pat. No. 8,056,240, which is a continuation of application No. 12/607,850, filed on Oct. 28, 2009, now Pat. No. 7,856,721, which is a continuation-in-part of application No. 12/394,557, filed on Feb. 27, 2009, now Pat. No. 7,814,660, which is a continuation of application No. 11/338,366, filed on Jan. 24, 2006, now Pat. No. 7,500,312.

(51) Int. Cl.
*B26B 21/14* (2006.01)

(52) U.S. Cl.
USPC ..... 30/57; 30/70

(58) Field of Classification Search ..... 30/50, 70
See application file for complete search history.

(56) References Cited

U.S. PATENT DOCUMENTS

| | | | |
|---|---|---|---|
| 1,792,415 | A | 2/1931 | Dean |
| 1,844,318 | A | 2/1932 | Gaisman |
| 1,888,159 | A | 11/1932 | Campbell |
| 1,958,718 | A | 5/1934 | Schermack |
| 2,077,805 | A | 4/1937 | Muros |
| 2,245,420 | A | 6/1941 | Volz |
| 2,281,531 | A | 4/1942 | Casner |
| 2,359,584 | A | 10/1944 | Roehner |
| 2,606,280 | A | 6/1952 | Stroschein |
| 2,621,389 | A | 12/1952 | Von Hildenstam et al. |
| 2,632,242 | A | 3/1953 | Musso |
| 2,677,884 | A | 5/1954 | Richard |
| 2,851,772 | A | 9/1958 | Monnet |

(Continued)

FOREIGN PATENT DOCUMENTS

| | | |
|---|---|---|
| GB | 360988 | 11/1931 |
| GB | 360988 A | 11/1931 |

OTHER PUBLICATIONS

Become.com, "Butcher bell scraper—compare prices, research products, save money at Become.com", Internet web page, Become.com, downloaded Sep. 10, 2007, URL: http://www.become.com/butcher-bell-scraper.

(Continued)

*Primary Examiner* — Maurina Rachuba
(74) *Attorney, Agent, or Firm* — Fulwider Patton LLP

(57) ABSTRACT

The scrubbing razor includes a handle, an elongated head with a blade mounting portion, and one or more forward straight blades and one or more rearward straight blades mounted to and extending from the underside of the blade mounting portion. The one or more rearward straight blades are mounted in opposing relation to the one or more forward straight blades, so that the scrubbing razor is bidirectional. The cutting edges of the one or more forward straight blades and the opposing cutting edges of the one or more rearward straight blades define a single plane.

8 Claims, 21 Drawing Sheets

U.S. PATENT DOCUMENTS

| | | | | |
|---|---|---|---|---|
| 3,127,676 | A | 4/1964 | Johnson | |
| 3,343,056 | A | 9/1967 | Hirschmann et al. | |
| 3,465,436 | A | 9/1969 | Musso | |
| 3,613,233 | A | 10/1971 | Lundell | |
| 3,810,305 | A | 5/1974 | Perry | |
| 4,031,620 | A | 6/1977 | Pomfret | |
| 4,336,651 | A | 6/1982 | Caro | |
| 4,590,674 | A | 5/1986 | Harper | |
| 4,807,360 | A | 2/1989 | Cerier et al. | |
| 4,875,288 | A | 10/1989 | Trotta et al. | |
| 4,977,670 | A | 12/1990 | Iten | |
| 5,199,173 | A | 4/1993 | Hegemann et al. | |
| 5,704,127 | A | 1/1998 | Cordio | |
| 6,145,201 | A | 11/2000 | Andrews | |
| 6,161,288 | A | 12/2000 | Andrews | |
| 6,505,403 | B1 | 1/2003 | Andrews | |
| 6,671,960 | B2 | 1/2004 | Kawafune et al. | |
| 7,322,109 | B2 | 1/2008 | Newkirk et al. | |
| 7,856,721 | B2 * | 12/2010 | Harris, II | 30/57 |
| 8,056,240 | B2 * | 11/2011 | Harris, II | 30/50 |
| 2002/0050065 | A1 | 5/2002 | Kludjian et al. | |
| 2004/0128835 | A1 | 7/2004 | Coffin et al. | |

OTHER PUBLICATIONS

Sullivan's Supply Line, "Fleshing Tools", Internet web page, sullivansline.com, downloaded Sep. 10, 2007, URL: http://www.sullivansline.com/sline/furhand/furflesh.aspx.

International Search Report, Jul. 11, 2012, 6 pages.

* cited by examiner

SCRUBBING RAZOR

CROSS-REFERENCES TO RELATED APPLICATIONS

This application is a continuation of application Ser. No. 12/909,868, filed Oct. 20, 2010, now U.S. Pat. No. 8,056,240, which is a continuation of application Ser. No. 12/607,850, filed Oct. 28, 2009, now U.S. Pat. No. 7,856,721, which is continuation-in-part of application Ser. No. 12/394,557, filed Feb. 27, 2009, now U.S. Pat. No. 7,814,660, issued Oct. 19, 2010, which is a continuation of application Ser. No. 11/338,366, filed on Jan. 24, 2006, now U.S. Pat. No. 7,500,312, issued on Mar. 10, 2009, the entire contents of which are incorporated herein by reference.

BACKGROUND OF THE INVENTION

1. Field of the Invention

This invention relates to shaving razors, and more particularly relates to an improved safety razor shaving apparatus.

2. General Background and State of the Art

Manual safety razors have typically been based upon the addition of some type of guard adjacent to an edge of a cutting blade. The early single-edge safety razor, having a steel blade with a guard along one edge, and the double-edged razor with a replaceable stainless steel blade presented the risk of accidental cuts from handling of the blades. Such manual razors must be aligned and drawn precisely in a straight direction across the skin of the user, at an appropriate angle in order to be effective. Modern cartridge-style razors injector blades, designed to fit into disposable plastic handles, can be handled more safely, and can be used effectively with less precision. Such injector blade cartridges are available with single or multiple parallel blades presented on one side of the razor. However, such razors still must be aligned and drawn carefully across the user's skin to provide effective shaving.

Electric razors provide a shearing head driven by a small motor, typically having an outer section with a series of slots to grip hairs, and an inner series of cutting blades. While electric razors with reciprocating blades typically need to be aligned and drawn carefully in a direction of shaving along a user's skin, electric razors with one or more rotary blades allow the razor to be held by the user and drawn in any direction and in a straight or circular motion as may be desired along the user's skin. However, such rotary electric razors require a source of electric power, either to operate the razor directly or to charge a battery of the razor, and have expensive head and blade cartridges that require maintenance and periodic replacement. It would therefore be desirable to provide a manually operable safety razor that does not require electrical power for operation, that provides that advantages of a rotary razor in allowing the razor to be held by the user and drawn in any direction and in any motion as may be desired along the user's skin. The present invention satisfies these and other needs.

SUMMARY OF THE INVENTION

Briefly, and in general terms, the invention provides for a scrubbing razor that can be operated manually and does not require electrical power for operation, and that allows a user to draw one or more cutting blades of the razor along the user's skin.

The present invention accordingly provides for a scrubbing razor including a housing and one or more cutting blades with a circular cutting edge. The housing includes a top cover, a tubular outer safety ring mounted to the top cover, and one or more tubular anchor rings disposed within the tubular outer safety ring and mounted to the top cover. The top cover typically has a surface defining a plurality of mounting holes, and a plurality of flow passage openings, and the tubular outer safety ring has a surface defining a plurality of mounting holes for connection of a corresponding plurality of fasteners to the mounting holes of the top cover. The one or more cutting blades are mounted to the one or more tubular anchor rings.

In a presently preferred aspect, the one or more cutting blades may be a circular blade, with an outer circular cutting edge, which preferably has a concavely curved inner surface and a convexly curved outer surface. In another presently preferred aspect, the one or more cutting blades may be one or more annular blades, with outer circular cutting edges.

In one variation, the one or more annular blades each may be formed as a single or double-edged annular concave rounded blade having a concavely curved upper side surface and a convexly curved bottom side surface, with a radially outer round cutting edge, and may optionally include a radially inner round cutting edge. The annular concave rounded blade may be formed to have a substantially circular shape, with substantially circular cutting blades, or may be formed to have an oval shape, with oval shaped cutting blades.

In another variation, the one or more annular blades each may be formed as a single or double-edged annular flat rounded blade, having a planar upper side surface and a planar bottom side surface, with a radially outer rounded cutting edge, and may optionally include a radially inner rounded cutting edge. The annular flat rounded blade may be formed to have a substantially circular shape, with substantially circular cutting edges, or may be formed to have an oval shape, with oval cutting edges.

In another variation, the one or more annular cutting blades each may be formed as a single-edged annular truncated cone-shaped rounded blade having a planar upper side surface and a planar lower side surface, with a radially outer rounded downwardly deflected cutting edge, and a radially inner rounded, upwardly deflected edge. The annular truncated cone-shaped rounded blade may be formed to have a substantially circular shape, with a substantially circular radially outer cutting edge, or may be formed to have an oval shape, with an oval radially outer cutting edge.

In another variation, the one or more annular cutting blades each may be formed as a single-edged annular inverted truncated cone-shaped rounded blade having a planar upper side surface and a planar lower side surface, with a radially inner rounded, downwardly deflected cutting edge, and a radially outer rounded, upwardly deflected edge. The annular inverted truncated cone-shaped rounded blade may be formed to have a substantially circular shape, with a substantially circular radially inner cutting edge, or may be formed to have an oval shape, with an oval radially inner cutting edge.

In another presently preferred aspect, the one or more tubular anchor rings include a plurality of lower apertures for receiving a corresponding plurality of fastener members for mounting of the one or more cutting blades. One or more inner slide rings may also be disposed within and adjacent to the one or more anchor rings. In another currently preferred aspect, the one or more anchor rings have surface defining a plurality of upper slots, and the scrubbing razor includes a spider brace member having a plurality of arms slidably received in the upper slots of the one or more inner anchor rings. The scrubbing razor may also include an annular safety ring shim interposed between the top cover and the outer safety ring, and the annular safety ring shim includes a plurality of mounting holes for receiving the plurality of fasteners to the mounting holes of the top cover.

In another presently preferred aspect, the top cover includes a plurality of flow passage openings, and the outer safety ring and the one or more anchor ring define a space therebetween; and when a plurality of anchor rings are provided, the plurality of anchor rings define spaces therebetween, so that the scrubbing razor can easily be washed with water to clean the scrubbing razor.

In another embodiment, the present invention provides for a bidirectional scrubbing razor including a handle having a forward end, a rearward end, and an elongated head extending substantially perpendicular to a longitudinal axis of the handle at the forward end of the handle. The elongated head includes a blade mounting portion having an upper side and an underside, and one or more straight blades providing opposing cutting edges extending at oblique angles with respect to the blade mounting portion, with the opposing cutting edges and the underside of the blade mounting portion substantially defining a single common cutting plane. In one preferred aspect, the one ore more straight blades include one or more forward straight blades mounted to and extending from the underside of the blade mounting portion, and one or more rearward straight blades mounted to and extend from the underside of the blade mounting portion in opposing relation to the one or more forward straight blades. The one or more forward straight blades each have a cutting edge, and the one or more rearward straight blades each have a cutting edge in opposing relation to the cutting edges of the one or more forward straight blades. In a presently preferred aspect, the cutting edges of the one or more forward straight blades and the opposing cutting edges of the one or more rearward straight blades define a single plane. The elongated head of the bidirectional scrubbing razor may be fixedly and integrally joined to the handle, and the blade mounting portion may be pivotally mounted to the elongated head.

In one presently preferred form of the bidirectional scrubbing razor, the cutting edges of the one or more forward straight blades of the bidirectional scrubbing razor and the one or more rearward straight blades of the bidirectional scrubbing razor face obliquely outwardly from a middle portion of the blade mounting portion. In another preferred aspect of this form of the bidirectional scrubbing razor, the cutting edges of the one or more forward straight blades also face obliquely away from the cutting edges of the one or more rearward straight blades.

In another presently preferred variation of the bidirectional scrubbing razor, the cutting edges of the one or more forward straight blades and the one or more rearward straight blades face obliquely inwardly toward a middle portion of the blade mounting portion. In another preferred aspect of this variation of the bidirectional scrubbing razor, the cutting edges of the one or more forward straight blades face obliquely toward the opposing cutting edges of the one or more rearward straight blades.

Another presently preferred variation of the bi-directional scrubbing razor includes one or more double edge blades including opposing lateral cutting edges extending obliquely away from a middle portion of the double edge blade. The one or more double edge blades are captured in a blade mounting portion including a lower cap, and the lower cap and one or more double edged cutting blades include central apertures for receiving a coupling member or other attachments means at the forward end of the handle for attaching the blade mounting portion and double edge blade to the forward end of the handle. An upper blade guard may also be provided between the forward end of the handle and the double edge cutting blade. The opposing lateral edges of the lower cap of the blade mounting portion form a lower face of the underside of the blade mounting portion, and the lower face of the blade mounting portion and the opposing lateral cutting edges of the double edge blade substantially define a single common cutting plane.

These and other aspects and advantages of the invention will become apparent from the following detailed description and the accompanying drawings, which illustrate by way of example the features of the invention.

DETAILED DESCRIPTION OF THE PREFERRED EMBODIMENTS

Figure 1:
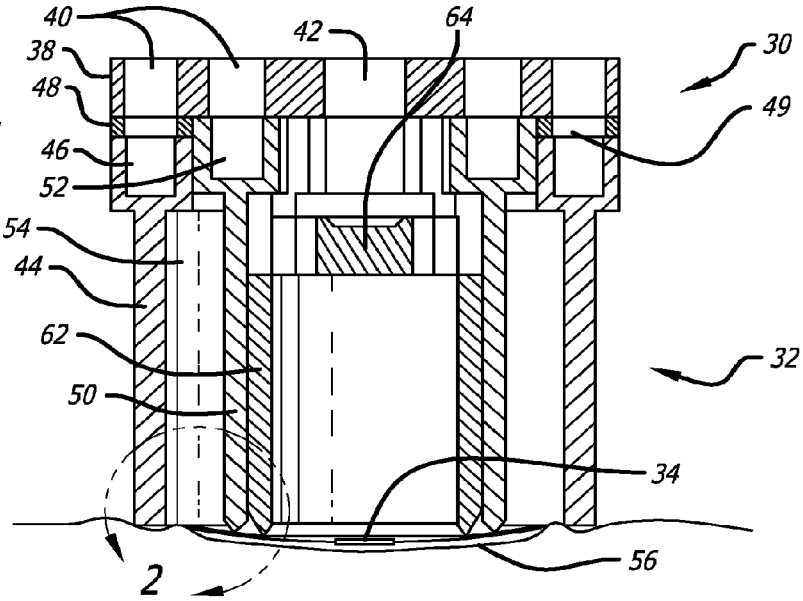
FIG. 1 is a sectional view of a first embodiment of the scrubbing razor according to the invention, shown applied to a user's skin.
Figure 2:
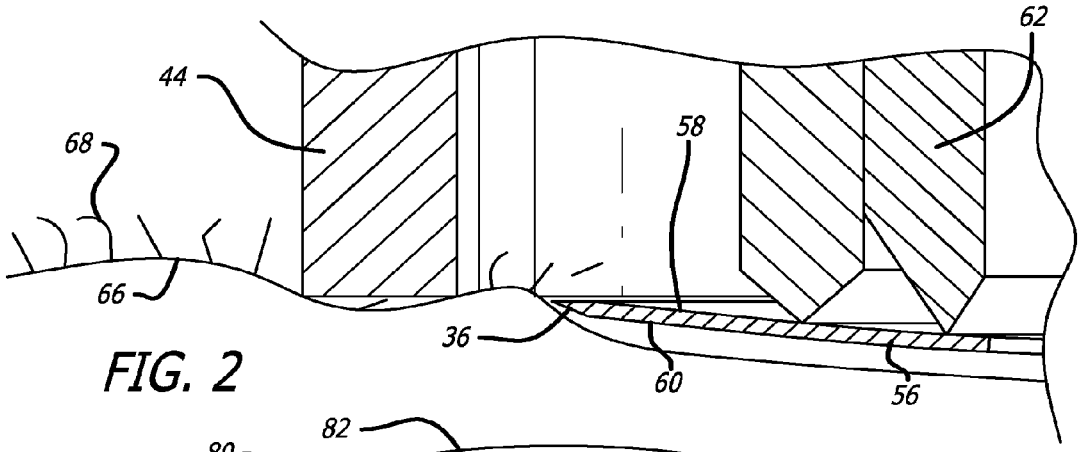
FIG. 2 is an enlarged view of a portion of the scrubbing razor of FIG. 1 shown applied to a user's skin for cutting hair.
Figure 5:
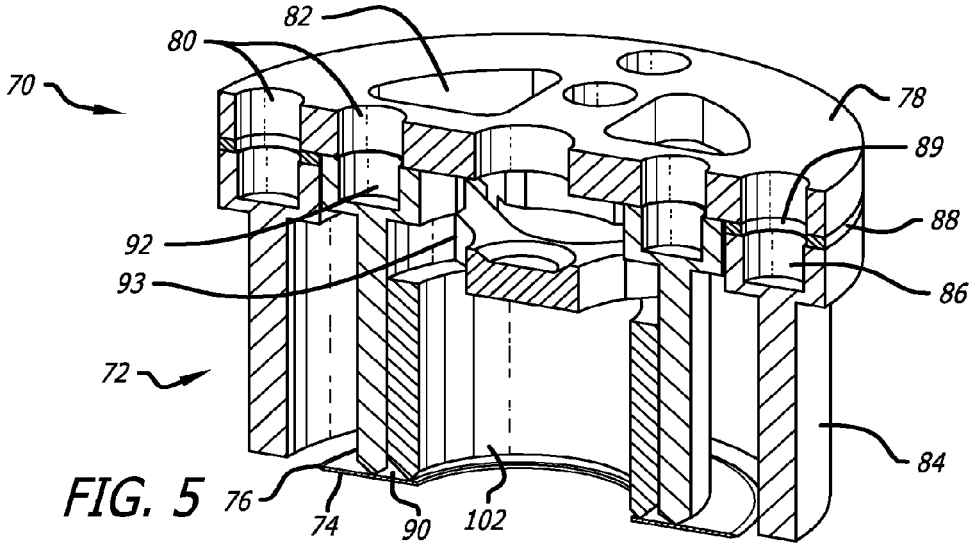
FIG. 5 is a top perspective sectional view of the scrubbing razor of FIG. 3.
Figure 3:
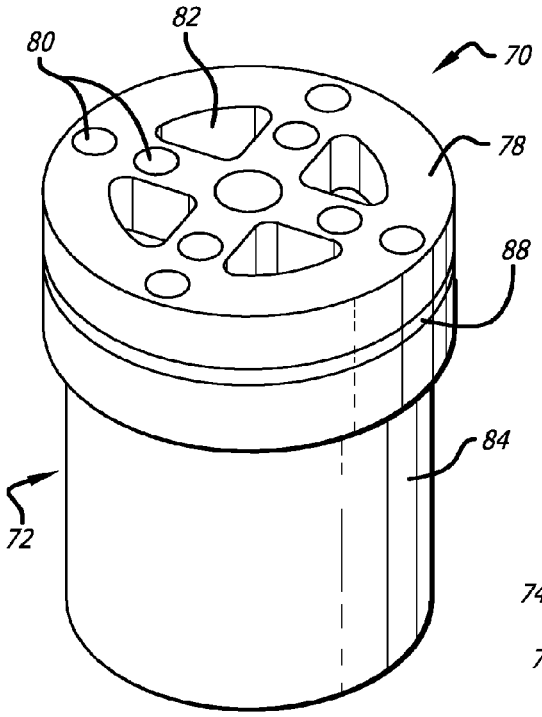
FIG. 3 is a top perspective view of a second embodiment of the scrubbing razor according to the invention.
Figure 4:
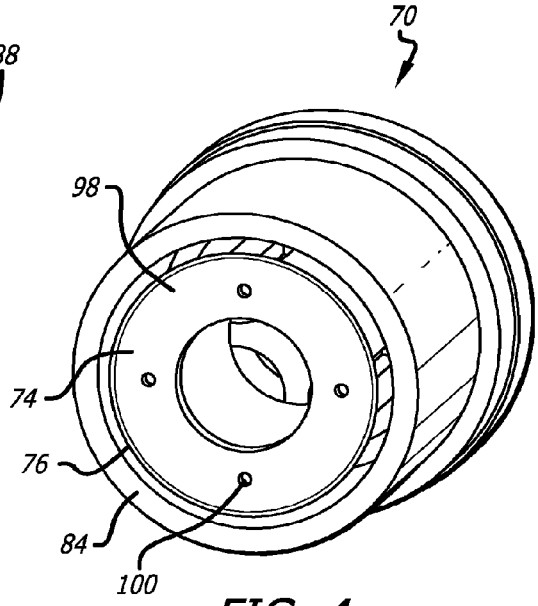
FIG. 4 is a bottom perspective view of the scrubbing razor of FIG. 3.
Figure 6:
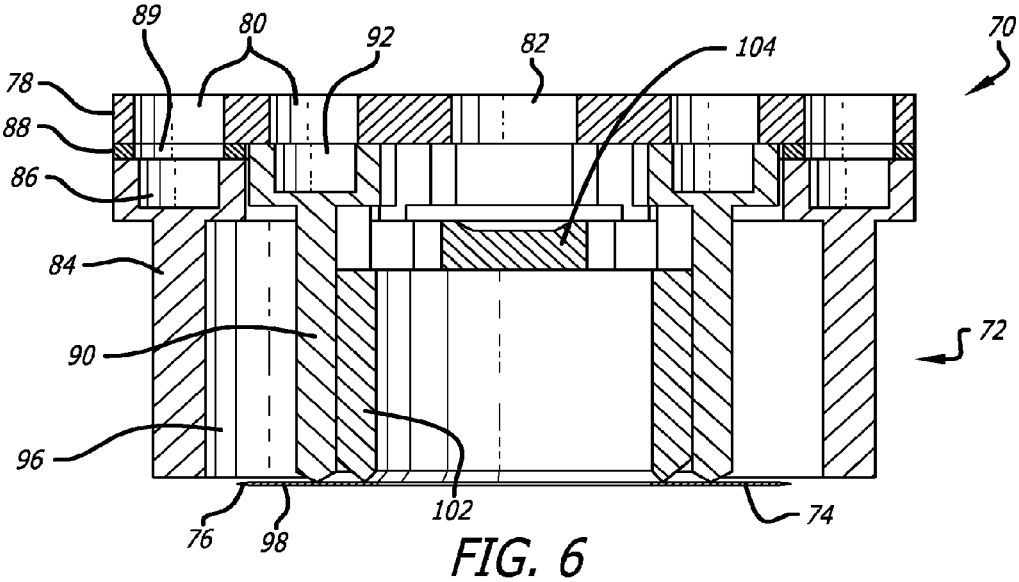
FIG. 6 is a cross-sectional view of the scrubbing razor taken along line 5-5 of FIG. 3.
Figure 7:
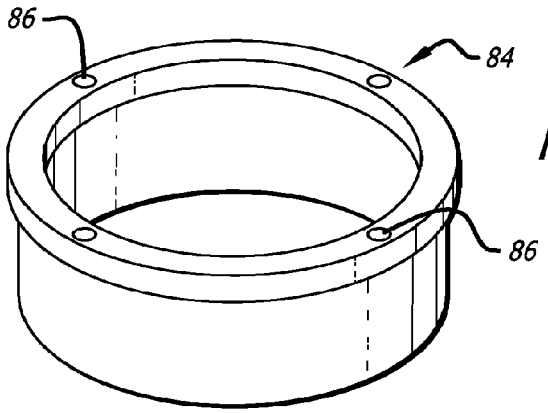
FIG. 7 is a top perspective view of the outer safety ring of the scrubbing razor of FIG. 3.
Figure 9:
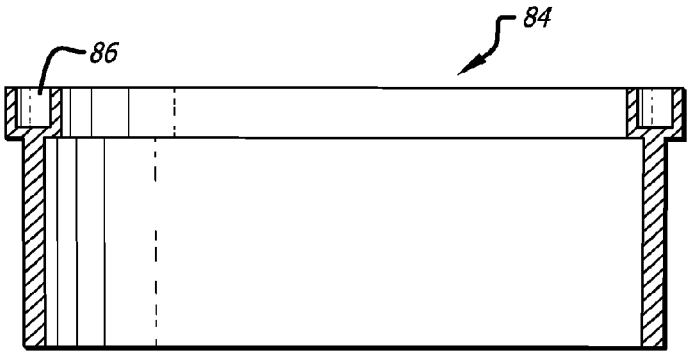
FIG. 9 is a cross-sectional view of the outer safety ring of the scrubbing razor taken along line 9-9 of FIG. 8.
Figure 8:
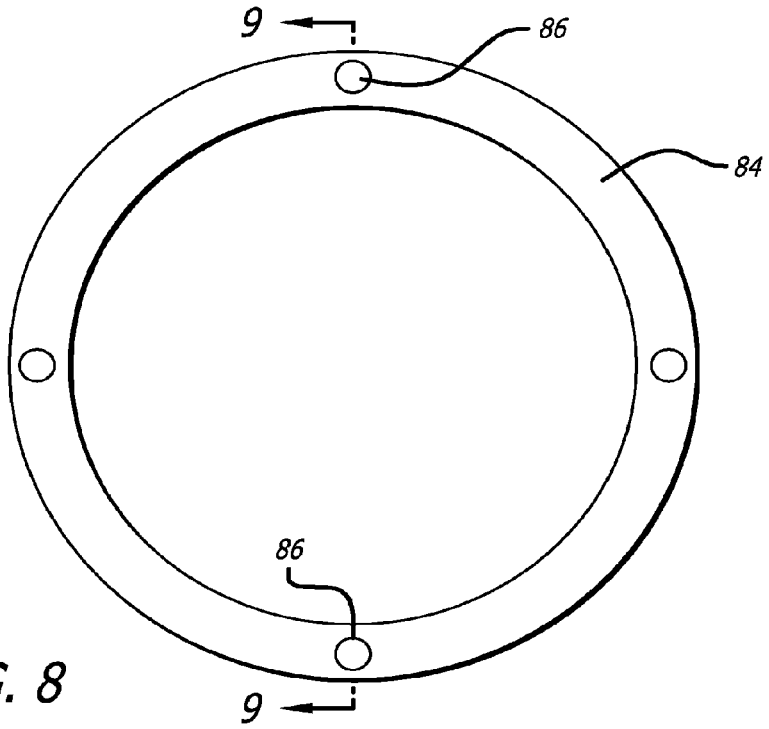
FIG. 8 is a top plan view of the outer safety ring of the scrubbing razor of FIG. 3.
Figure 10:
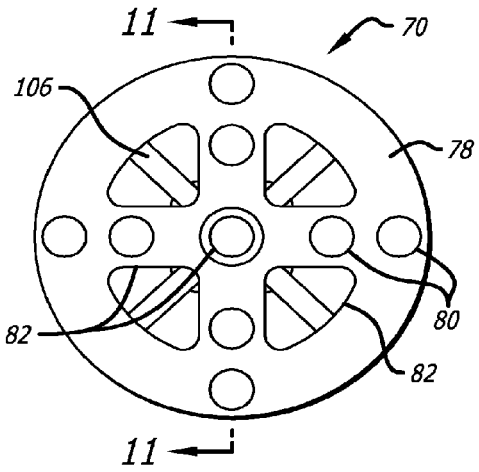
FIG. 10 is a top plan view of the scrubbing razor of FIG. 3.
Figure 11:
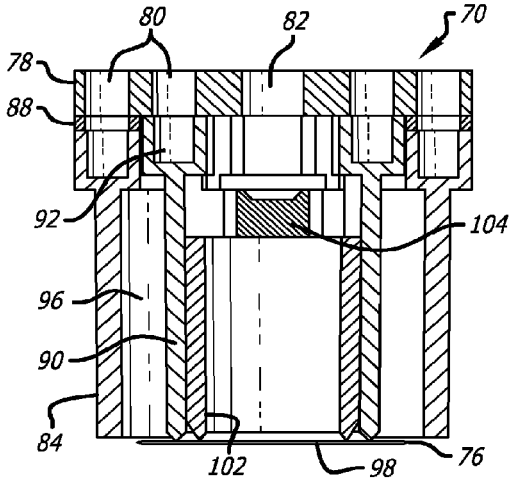
FIG. 11 is a cross-sectional view of the scrubbing razor taken along line 11-11 of FIG. 10.
Figure 12:
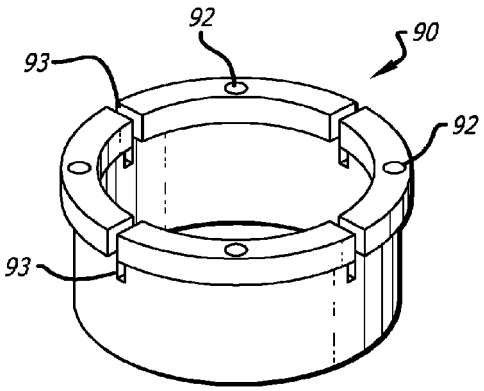
FIG. 12 is a top perspective view of the anchor ring of the scrubbing razor of FIG. 3.
Figure 13:
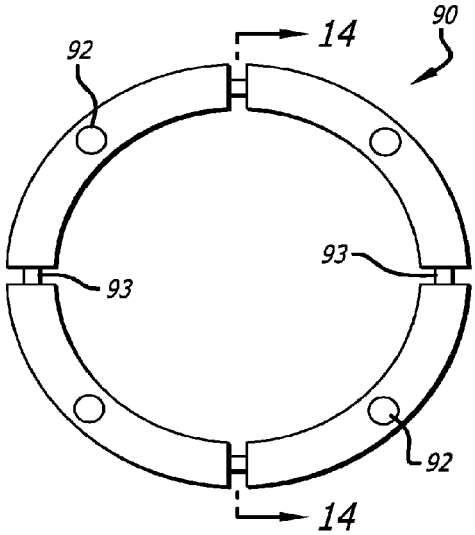
FIG. 13 is a top plan view of the anchor ring of the scrubbing razor of FIG. 3.
Figure 14:
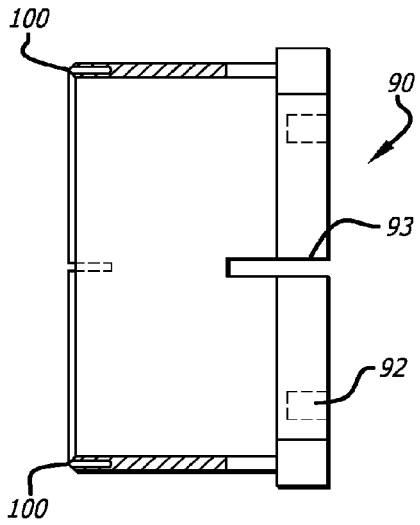
FIG. 14 is a cross-sectional view of the anchor ring taken along line 14-14 of FIG. 13.
Figure 15:
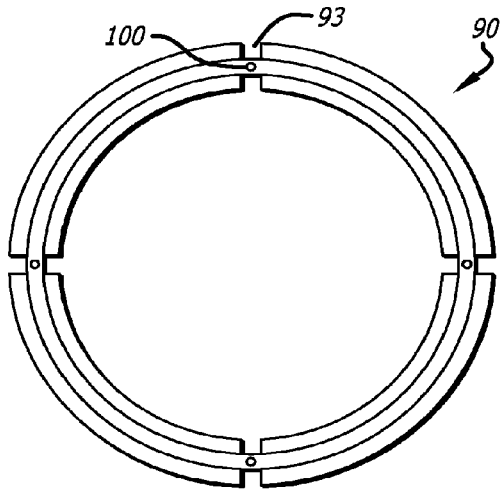
FIG. 15 is a bottom plan view of the anchor ring of FIG. 13.
Figure 16:
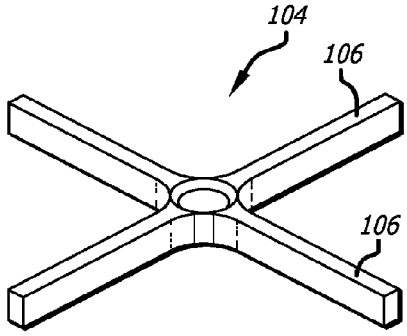
FIG. 16 is a perspective view of the spider brace member of the scrubbing razor of FIG. 3.
Figure 17:
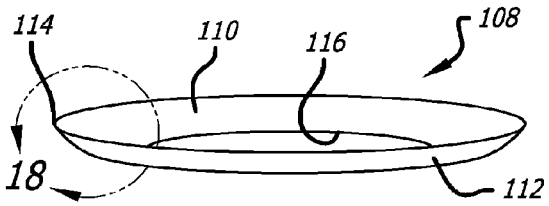
FIG. 17 is a perspective view of a variation of the single annular blade of the second embodiment, having a single or double-edged concave rounded configuration.

As is illustrated in FIGS. 1-2, in a first embodiment, the scrubbing razor 30 includes a housing 32, and a cutting blade 34 having a circular cutting edge 36. The housing includes a top cover 38 with a plurality of mounting holes 40 for mounting screws or bolts, and a plurality of flow passage openings 42 in the top cover that provide fluid flow passages. The housing also includes a tubular outer safety ring 44, with upper holes 46 for mounting screws or bolts to mount the outer safety ring to the top cover, and optionally includes a safety ring shim 48 interposed between the top cover and the outer safety ring, with holes 49 for the mounting screws or bolts to mount the outer safety ring to the top cover. The outer circular cutting edge of the cutting blade is guarded by the adjacent outer safety ring. The scrubbing razor also includes a tubular inner anchor ring 50, with upper holes 52 for mounting screws or bolts for mounting to corresponding mounting holes in the top cover, and defining a space 54 between outer safety ring and inner anchor ring that connects with the fluid flow passages of the top cover, allowing the scrubbing razor to be cleaned simply by flushing water through the fluid flow passages of the top cover and the space between the outer safety ring and inner anchor ring, and past the cutting blade.

In this embodiment, the cutting blade is formed by a single circular blade 56, which in a presently preferred aspect has a concavely curved inner surface 58 and a convexly curved outer surface 60, with an outer circular cutting edge. The circular cutting blade may be mounted to the inner anchor ring with fasteners such as mounting pins or screws received in corresponding lower apertures in the anchor ring, as will be further described below. The scrubbing razor may also optionally include an inner slide ring 62 slidably disposed within and adjacent to the inner anchor ring and interposed between the upper surface of the cutting blade and a spider brace member 64, described further below.

Referring to FIG. 2, as the scrubbing razor is moved from left to right across a user's skin 66, it can be seen that when the skin comes in contact with the safety ring, and the safety ring is pressed down into the skin, the skin is depressed directly under the safety ring but is raised on both sides of the safety ring. Although the skin is raised in between the safety ring and the outer cutting edge of the cutting blade, the skin returns back down to a normal level under the pressure of the cutting blade as the scrubbing razor passes over the skin, and as the skin passes between the safety ring and the outer cutting surface of the blade, hair on the skin that is moved under the cutting edge is cut off by the passing blade. It can be seen that the safety ring serves as an effective guard of the cutting edge of the blade, without which the blade could cut into the unprotected skin when it is moved with a vigorous scrubbing action. However, the safety ring is spaced apart from the outer cutting edge of the cutting blade so that the user's skin is only allowed to pass near the cutting edge of the blade to a minimal degree, thus allowing the scrubbing razor to be effectively used with a 360 degree cutting motion and scrubbing action.

Referring to FIGS. 3-32, in a second preferred embodiment, the scrubbing razor 70 includes a housing 72 and a cutting blade 74 having a circular cutting edge 76. The housing includes a top cover 78 with a plurality of mounting holes 80 provided for mounting screws or bolts, and a plurality of flow passage openings 82 in the top cover. The housing of the scrubbing razor also includes a tubular outer safety ring 84 with upper holes 86 for mounting screws or bolts, and may include a safety ring shim 88, with holes 89 for mounting screws or bolts connecting the outer safety ring to corresponding mounting holes in the top cover. The cutting edge of the cutting blade is preferably an outer circular cutting edge, guarded by the adjacent outer safety ring. A tubular inner anchor ring 90 is also provided, with upper holes 92 for mounting screws or bolts, and upper slots 93 and lower apertures 94 for fastener members, such as screws. An annular anchor ring shim (not shown) may also be interposed between the inner anchor ring and the top cover. The outer safety ring and inner anchor ring define a space 96 therebetween.

In the second embodiment, the cutting blade is formed by a single annular blade 98, having surface defining a plurality of apertures 100 for mounting fastener members, such as interference fit pins or screws (not shown) to be received in the lower apertures of the inner anchor ring. The housing may optionally include an inner slide ring 102 slidably disposed within and adjacent to the anchor ring and interposed between the upper surface of the cutting blade and a spider brace member spider brace member 104, having a plurality of arms 106 slidably received in the upper slots of the inner anchor ring.

Figure 18:
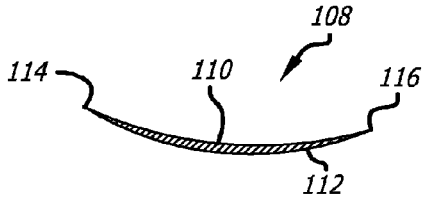
FIG. 18 is a sectional view of a portion of the single annular blade of FIG. 17.
Figure 19:
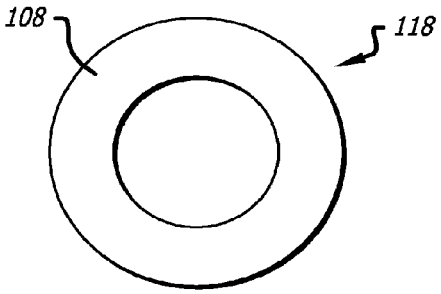
FIG. 19 is a top plan view of the single annular blade of FIG. 17 having a circular shape.
Figure 20:
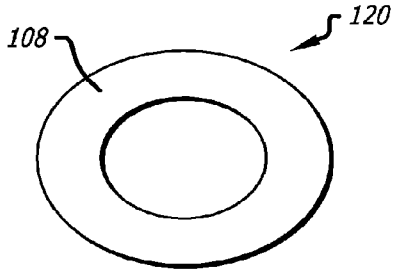
FIG. 20 is a top plan view of the single annular blade of FIG. 17 having an oval shape.
Figure 21:
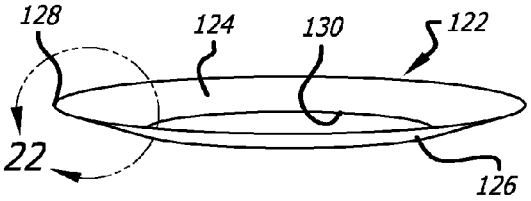
FIG. 21 is a perspective view of another variation of the single annular blade of the second embodiment, having a single or double-edged annular flat rounded configuration.

As is illustrated in FIGS. 17-20, in one variation of the second embodiment, the single annular blade may be formed as a single or double-edged annular concave rounded blade 108 having a concavely curved upper side surface 110 and a convexly curved bottom side surface 112, as shown in FIG. 18, with a radially outer round cutting edge 114, and may optionally include a radially inner round cutting edge 116. The annular concave rounded blade may be formed to have a substantially circular shape 118 as viewed from the top in FIG. 19, with substantially circular cutting blades, or may be formed to have an oval shape 120 as viewed from the top in FIG. 20, with oval shaped cutting blades.

Figure 22:
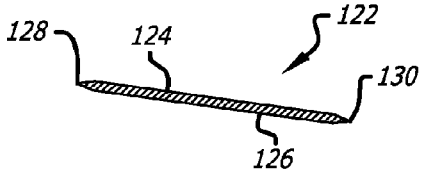
FIG. 22 is a sectional view of a portion of the single annular blade of FIG. 21.
Figure 23:
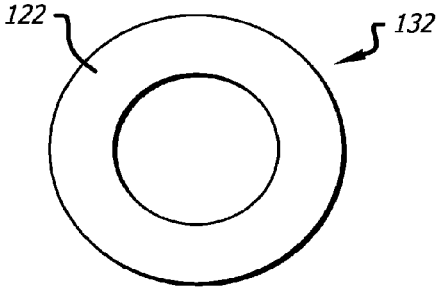
FIG. 23 is a top plan view of the single annular blade of FIG. 21 having a circular shape.
Figure 24:
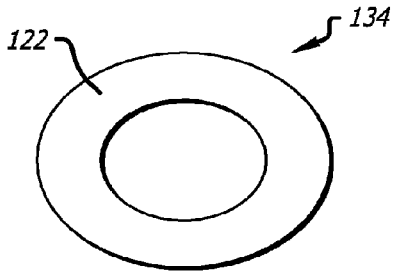
FIG. 24 is a top plan view of the single annular blade of FIG. 21 having an oval shape.
Figure 25:
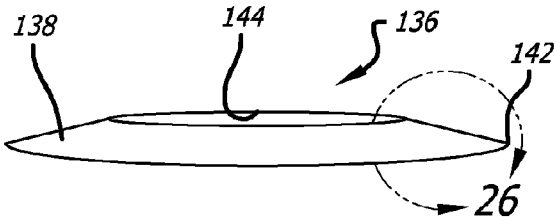
FIG. 25 is a perspective view of another variation of the single annular blade of the second embodiment, having a single-edged annular truncated cone-shaped rounded configuration.
Figure 26:
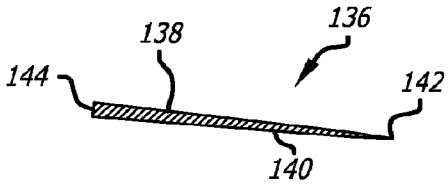
FIG. 26 is a sectional view of a portion of the single annular blade of FIG. 25.
Figure 27:
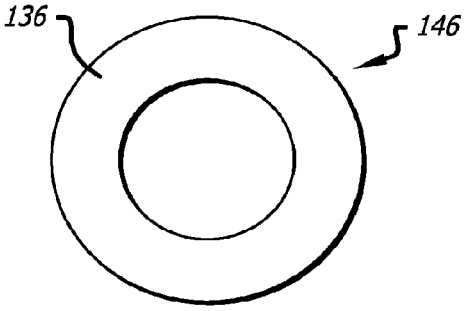
FIG. 27 is a top plan view of the single annular blade of FIG. 25 having a circular shape.
Figure 28:
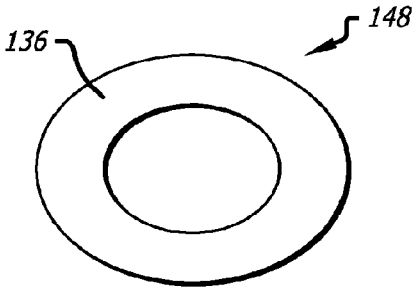
FIG. 28 is a top plan view of the single annular blade of FIG. 25 having an oval shape.
Figure 29:
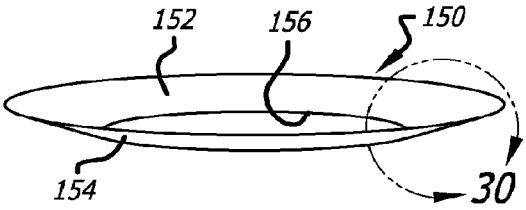
FIG. 29 is a perspective view of another variation of the single annular blade of the second embodiment, having a single-edged annular inverted truncated cone-shaped rounded configuration.
Figure 30:
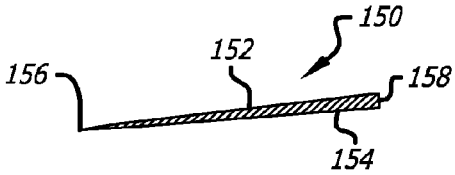
FIG. 30 is a sectional view of a portion of the single annular blade of FIG. 29.
Figure 31:
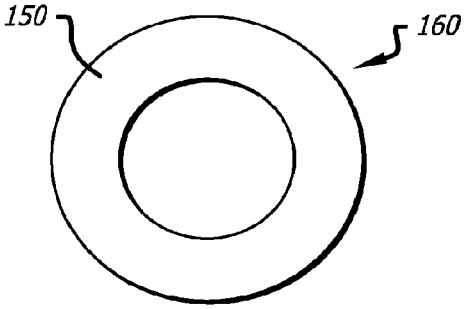
FIG. 31 is a top plan view of the single annular blade of FIG. 29 having a circular shape.
Figure 32:
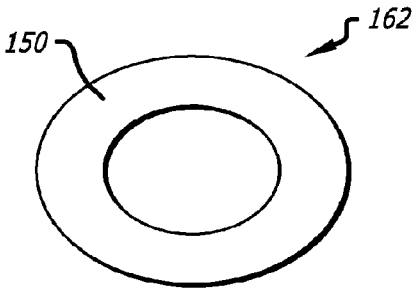
FIG. 32 is a top plan view of the single annular blade of FIG. 29 having an oval shape.
Figure 33:
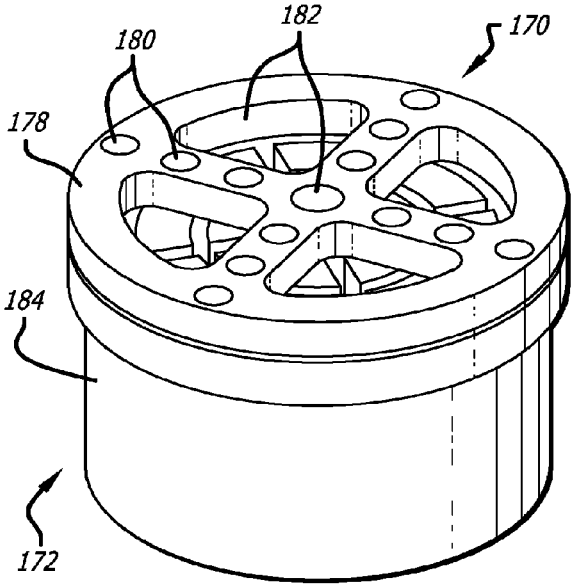
FIG. 33 is a top perspective view of a third embodiment of the scrubbing razor according to the invention.
Figure 34:
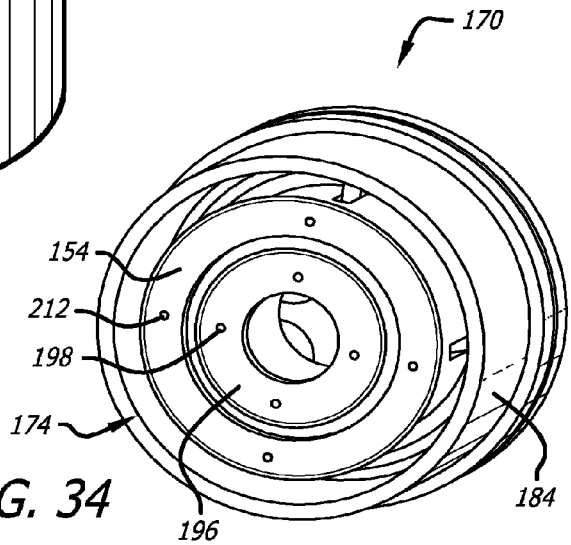
FIG. 34 is a bottom perspective view of the scrubbing razor of FIG. 33.
Figure 35:
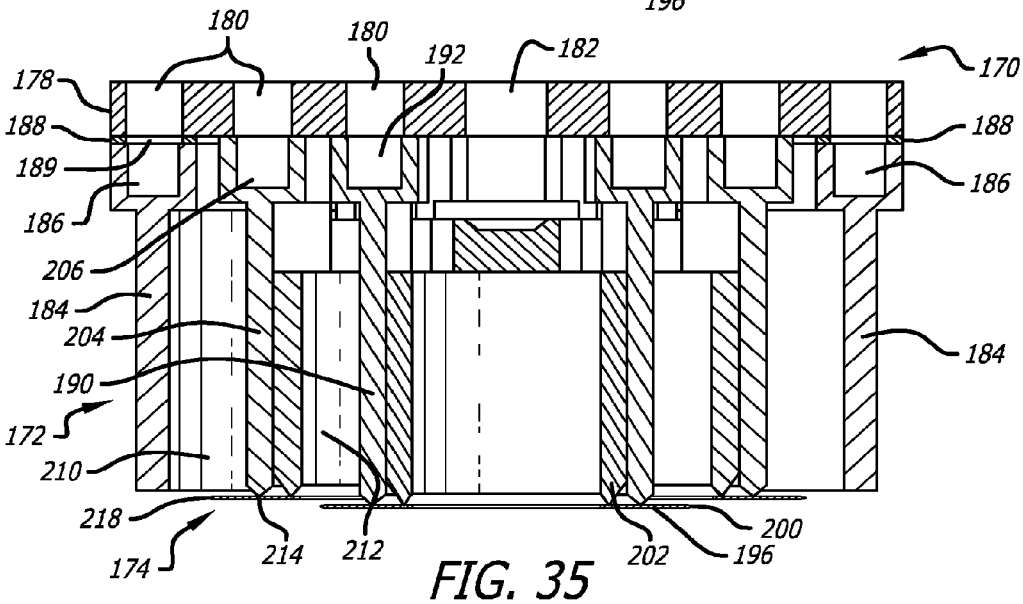
FIG. 35 is a cross-sectional view of the scrubbing razor taken along line 35-35 of FIG. 33.
Figure 36:
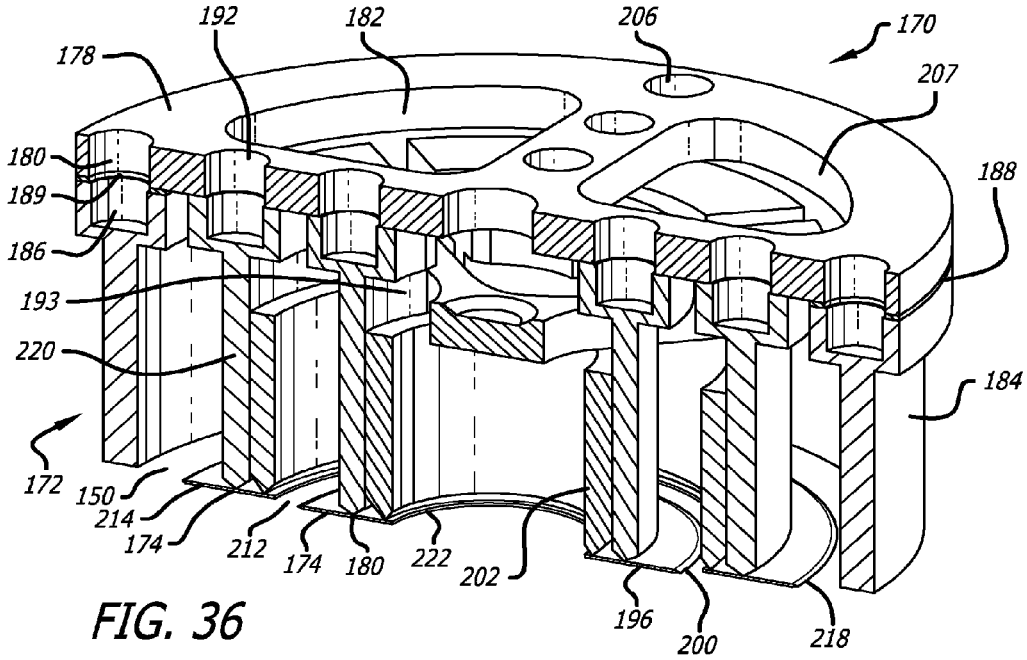
FIG. 36 is a top perspective sectional view of the scrubbing razor of FIG. 33.
Figure 37:
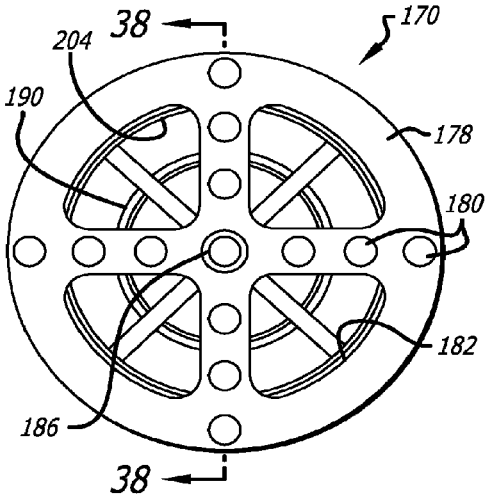
FIG. 37 is a top plan view of the scrubbing razor of FIG. 33.
Figure 38:
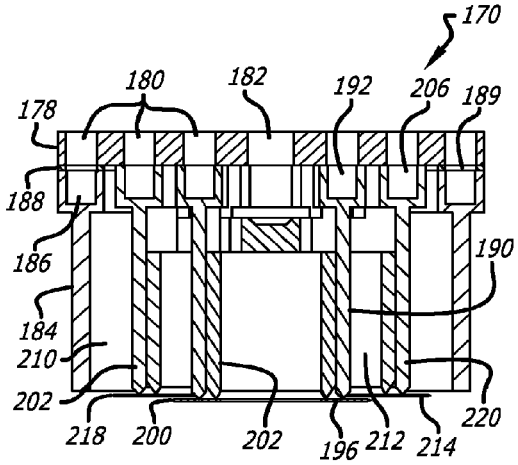
FIG. 38 is a cross-sectional view of the scrubbing razor taken along line 38-38 of FIG. 37.
Figure 39:
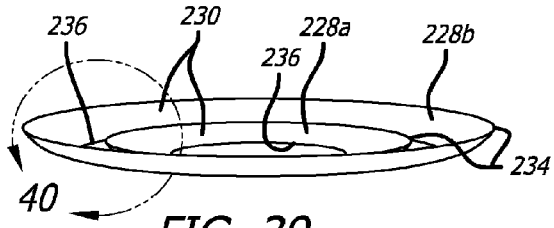
FIG. 39 is a perspective view of a variation of the two annular blades of the third embodiment, each blade having a single or double-edged concave rounded configuration.

In another variation of the second embodiment, illustrated in FIGS. 21-24, the single annular blade may be formed as a single or double-edged annular flat rounded blade 122, having a planar upper side surface 124 and a planar bottom side surface 126, as shown in FIG. 22, with a radially outer rounded cutting edge 128, and may optionally include a radially inner rounded cutting edge 130. The annular flat rounded blade may be formed to have a substantially circular shape 132 as viewed from the top in FIG. 23, with substantially circular cutting edges, or may be formed to have an oval shape 134, as viewed from the top in FIG. 24, with oval cutting edges.

As is illustrated in FIGS. 25-28, in another variation of the second embodiment, the single annular cutting blade may be formed as a single-edged annular truncated cone-shaped rounded blade 136 having a planar upper side surface 138 and a planar lower side surface 140, with a radially outer rounded downwardly deflected cutting edge 142, and a radially inner rounded, upwardly deflected edge 144. The annular truncated cone-shaped rounded blade may be formed to have a substantially circular shape 146 as viewed from the top in FIG. 27, with a substantially circular radially outer cutting edge, or may be formed to have an oval shape 148, as viewed from the top in FIG. 28, with an oval radially outer cutting edge.

As is illustrated in FIGS. 29-32, in another variation of the second embodiment, the single annular cutting blade may be formed as a single-edged annular inverted truncated cone-shaped rounded blade 150 having a planar upper side surface 152 and a planar lower side surface 154, with a radially inner rounded, downwardly deflected cutting edge 156, and a radially outer rounded, upwardly deflected edge 158. The annular inverted truncated cone-shaped rounded blade may be formed to have a substantially circular shape 160 as viewed from the top in FIG. 31, with a substantially circular radially inner cutting edge, or may be formed to have an oval shape 162, as viewed from the top in FIG. 32, with an oval radially inner cutting edge.

With reference to FIGS. 33-54, in a third preferred embodiment, the scrubbing razor 170 includes a housing 172, and at least one cutting blade 174 having a circular cutting edge. The housing includes a top cover 178, with mounting holes 180 for mounting screws or bolts, and a plurality of flow passage openings 182 in the top cover. The housing also includes a tubular outer safety ring 184, with upper holes 186 for mounting screws or bolts for fastening the outer safety ring to the mounting holes of the top cover. A safety ring shim 188 with holes 189 for mounting screws or bolts for mounting screws or bolts connecting the outer safety ring to corresponding mounting holes in the top cover may also optionally be provided.

The housing also includes a first inner tubular anchor ring 190, with upper holes 192 for mounting screws or bolts, upper slots 193, and lower apertures, as described above, for fastener members, such as interference fit pins or screws (not shown). A first annular anchor ring shim (not shown) may also be interposed between the first inner anchor ring and the top cover. In this embodiment, the one or more cutting blades include a first inner annular blade 196, with apertures 198 for fastener members, such as interference fit pins or screws, with an outer circular cutting edge 200. Optionally, the first inner annular blade may include an inner circular cutting edge. A first inner small slide ring 202 may also be slidably disposed within and adjacent to the first inner anchor ring.

A second outer tubular anchor ring 204 is also provided, with upper holes 206 for mounting screws or bolts, upper slots 207, and lower apertures, as described above, for fastener members, such as interference fit pins or screws. A second annular anchor ring shim (not shown) may also be interposed between the second inner anchor ring and the top cover. The outer safety ring and second outer anchor ring define a space 210 therebetween, and the first inner anchor ring and second outer tubular anchor ring define a space 212 therebetween. A second outer annular blade 214 is also provided, with apertures 216 for fastener members, such as interference fit pins or screws, and having an outer circular cutting edge 218. Optionally, the second inner annular blade may include an inner circular cutting edge. The scrubbing razor may also optionally include a second outer slide ring 220 slidably disposed within and adjacent to the second inner anchor ring. The first slide ring and second slide ring are also interposed between the upper surface of the first and second cutting blades, respectively, and a spider brace member 222, having a plurality of arms 224 slidably received in the upper slots of the first inner and second outer anchor rings.

Figure 40:
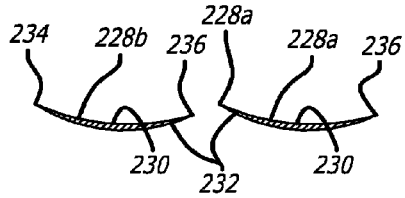
FIG. 40 is a sectional view of a portion of the two annular blades of FIG. 39.
Figure 41:
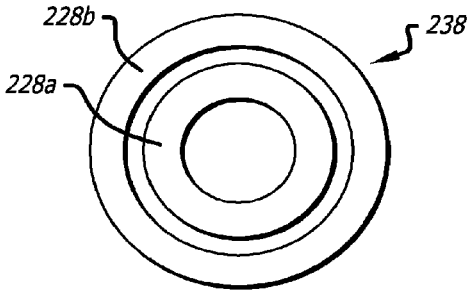
FIG. 41 is a top plan view of the two annular blades of FIG. 39 having a circular shape.
Figure 42:
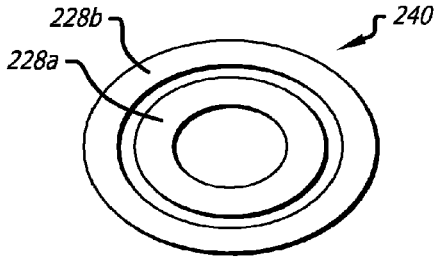
FIG. 42 is a top plan view of the two annular blades of FIG. 39 having an oval shape.
Figure 43:
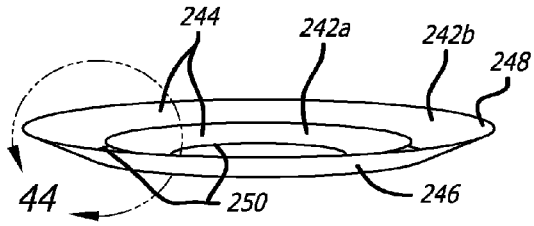
FIG. 43 is a perspective view of another variation of the two annular blades of the third embodiment, each blade having a single or double-edged annular flat rounded configuration.

As is illustrated in FIGS. 39-42, in one variation of the third embodiment, the double annular blades each may be formed as single or double-edged annular concave rounded blades 228*a*, 228*b* having a concavely curved upper side surface 230 and a convexly curved bottom side surface 232, as shown in FIG. 40, with a radially outer round cutting edge 234, and may optionally include a radially inner round cutting edge 236. The annular concave rounded blades may be formed to have a substantially circular shape 238 as viewed from the top in FIG. 41, with substantially circular cutting blades, or may be formed to have an oval shape 240 as viewed from the top in FIG. 42, with oval shaped cutting blades.

Figure 44:
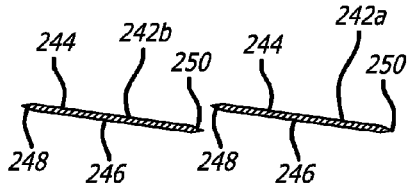
FIG. 44 is a sectional view of a portion of the two annular blades of FIG. 43.
Figure 45:
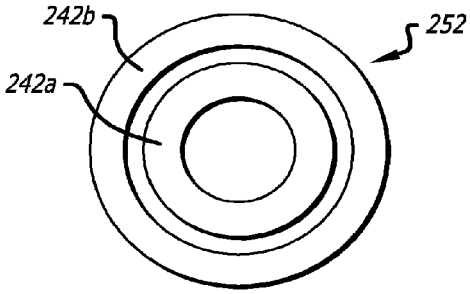
FIG. 45 is a top plan view of the two annular blades of FIG. 43 having a circular shape.
Figure 46:
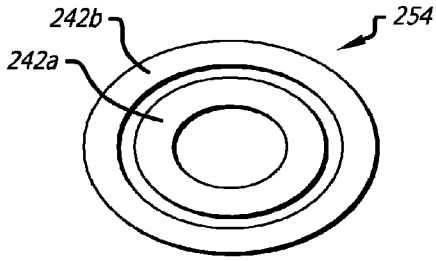
FIG. 46 is a top plan view of the two annular blades of FIG. 43 having an oval shape.
Figure 47:
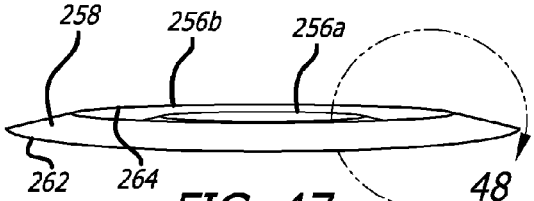
FIG. 47 is a perspective view of another variation of the two annular blades of the third embodiment, each blade having a single-edged annular truncated cone-shaped rounded configuration.
Figure 48:
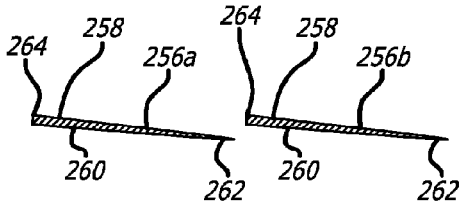
FIG. 48 is a sectional view of a portion of the two annular blades of FIG. 47.
Figure 49:
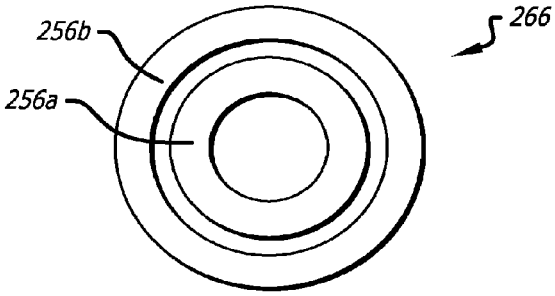
FIG. 49 is a top plan view of the two annular blades of FIG. 47 having a circular shape.
Figure 50:
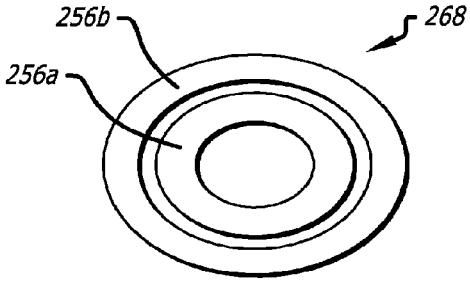
FIG. 50 is a top plan view of the two annular blades of FIG. 47 having an oval shape.
Figure 51:
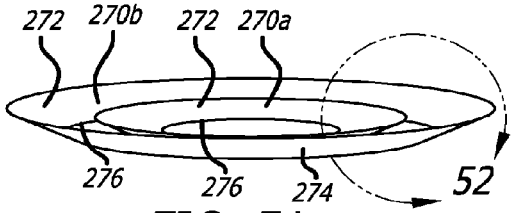
FIG. 51 is a perspective view of another variation of the two annular blades of the third embodiment, each blade having a single-edged annular inverted truncated cone-shaped rounded configuration.
Figure 52:
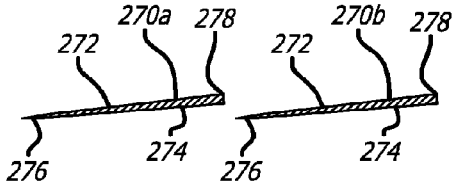
FIG. 52 is a sectional view of a portion of the two annular blades of FIG. 51.
Figure 53:
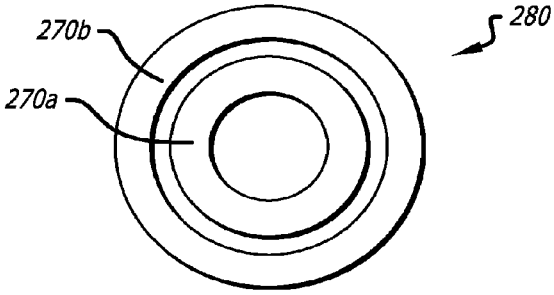
FIG. 53 is a top plan view of the two annular blades of FIG. 51 having a circular shape.
Figure 54:
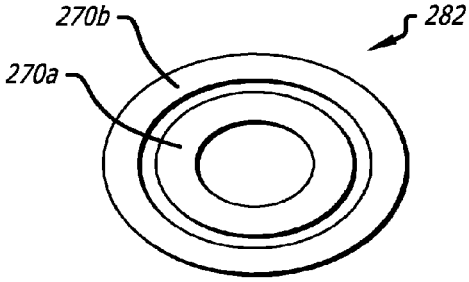
FIG. 54 is a top plan view of the two annular blades of FIG. 51 having an oval shape.
Figure 55:
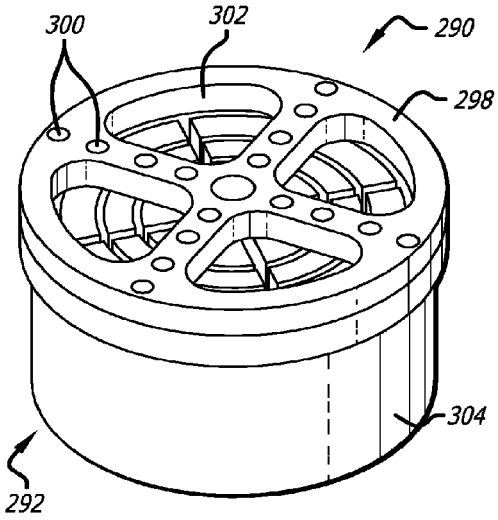
FIG. 55 is a top perspective view of a fourth embodiment of the scrubbing razor according to the invention.
Figure 56:
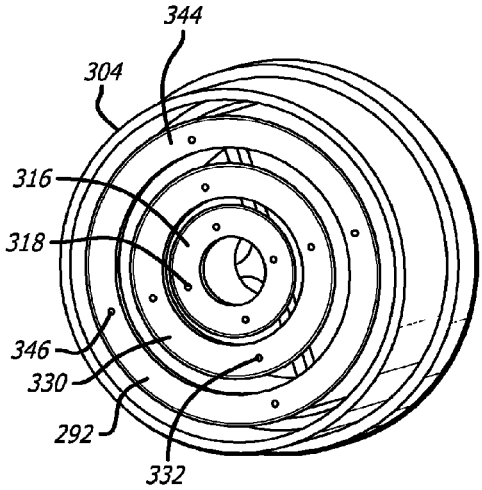
FIG. 56 is a bottom perspective view of the scrubbing razor of FIG. 55.
Figure 57:
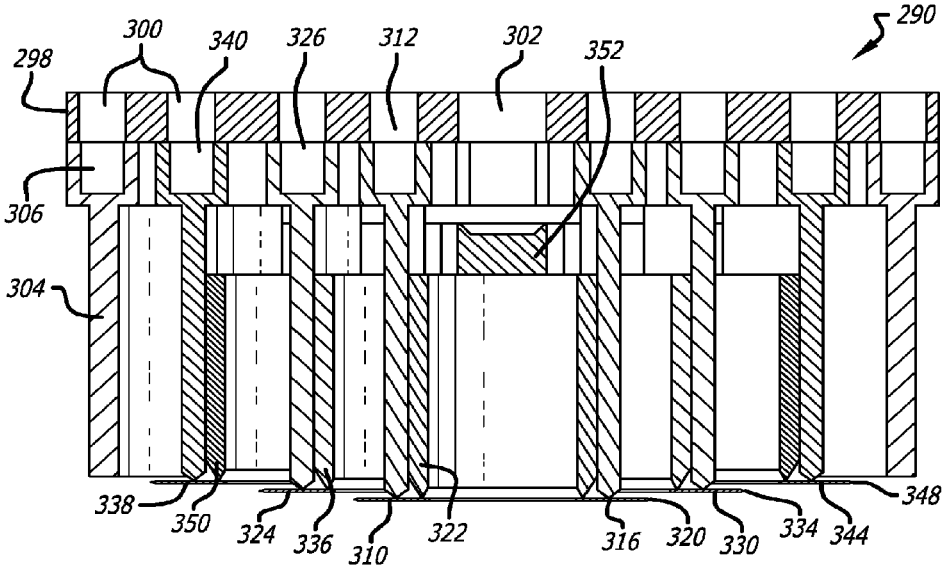
FIG. 57 is a cross-sectional view of the scrubbing razor taken along line 57-57 of FIG. 55.
Figure 58:
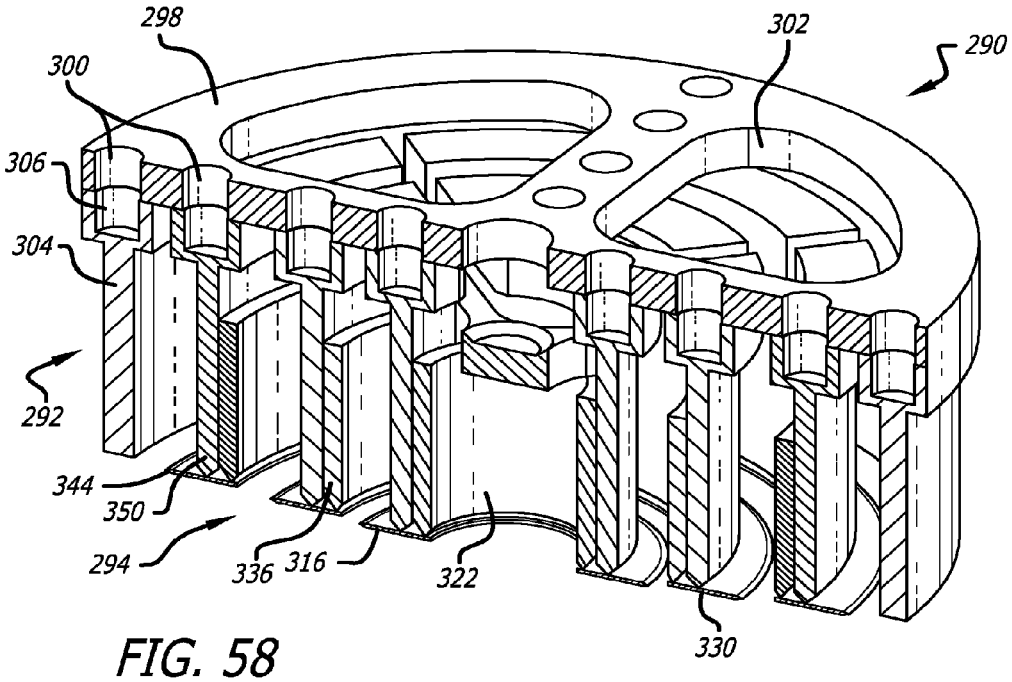
FIG. 58 is a top perspective sectional view of the scrubbing razor of FIG. 55.
Figure 59:
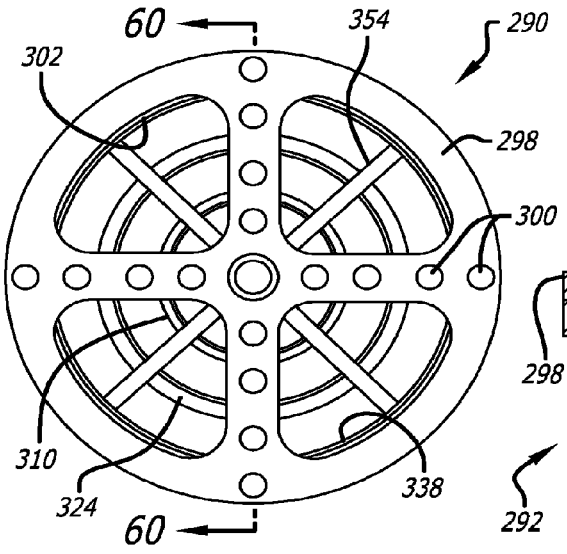
FIG. 59 is a top plan view of the scrubbing razor of FIG. 55.
Figure 60:
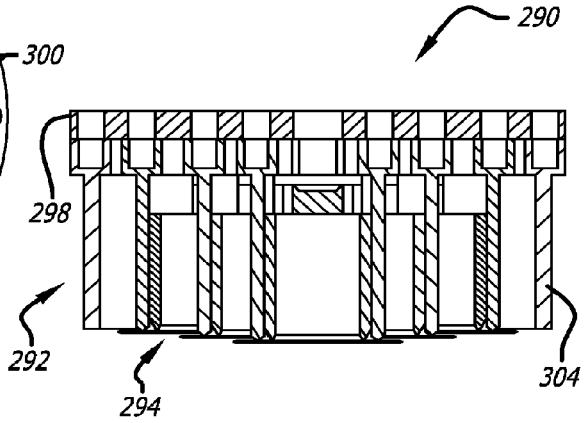
FIG. 60 is a cross-sectional view of the scrubbing razor taken along line 60-60 of FIG. 59.
Figure 61:
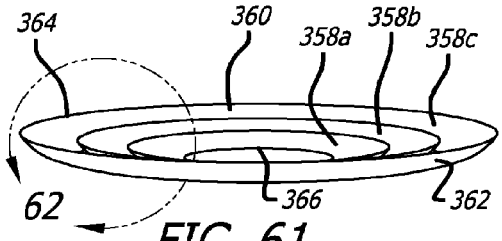
FIG. 61 is a perspective view of a variation of the three annular blades of the third embodiment, each blade having a single or double-edged concave rounded configuration.

In another variation of the third embodiment, illustrated in FIGS. 43-46, the double annular blades may be formed as single or double-edged annular flat rounded blades 242*a*, 242*b*, having a planar upper side surface 244 and a planar bottom side surface 246, as shown in FIG. 44, with a radially outer rounded cutting edge 248, and may optionally include a radially inner rounded cutting edge 250. The annular flat rounded blade may be formed to have a substantially circular shape 252 as viewed from the top in FIG. 45, with substantially circular cutting edges, or may be formed to have an oval shape 254, as viewed from the top in FIG. 46, with oval cutting edges.

As is illustrated in FIGS. 47-50, in another variation of the third embodiment, the double annular cutting blades each may be formed as single-edged annular truncated cone-shaped rounded blades 256*a*, 256*b* having a planar upper side surface 258 and a planar lower side surface 260, with a radially outer rounded downwardly deflected cutting edge 262, and a radially inner rounded, upwardly deflected edge 264. The annular truncated cone-shaped rounded blades may be formed to have a substantially circular shape 266 as viewed from the top in FIG. 49, with a substantially circular radially outer cutting edge, or may be formed to have an oval shape 268, as viewed from the top in FIG. 50, with an oval radially outer cutting edge.

As is illustrated in FIGS. 51-54, in another variation of the third embodiment, the double annular cutting blades each may be formed as single-edged annular inverted truncated cone-shaped rounded blades 270*a*, 270*b* having a planar upper side surface 272 and a planar lower side surface 274, with a radially inner rounded, downwardly deflected cutting edge 276, and a radially outer rounded, upwardly deflected edge 278. The annular inverted truncated cone-shaped rounded blade may be formed to have a substantially circular shape 280 as viewed from the top in FIG. 53, with a substantially circular radially inner cutting edge, or may be formed to have an oval shape 282, as viewed from the top in FIG. 54, with an oval radially inner cutting edge.

Referring to FIGS. 55-60, in a fourth embodiment, the scrubbing razor 290 includes a housing 292 and at least one cutting blade 294 having a circular cutting edge. The housing includes a top cover 298 with mounting holes 300 for mounting screws or bolts, and a plurality of flow passage openings 302. The housing also includes a tubular outer safety ring 304 with upper holes 306 for mounting screws or bolts, and may include a safety ring shim interposed between the top cover and the outer safety ring, with holes for mounting screws or bolts.

The scrubbing razor includes a first inner tubular anchor ring 310 with upper holes, as described above, for mounting screws or bolts, upper slots 313, and lower apertures, as described above, for fastener members, such as interference fit pins or screws. A first tubular anchor ring shim (not shown) may optionally be interposed between the first inner anchor ring and the top cover. The scrubbing razor includes a first inner annular blade 316, having apertures 318 for fastener members, such as interference fit pins or screws, and having an outer circular cutting edge 320. Optionally, the first inner annular blade may include an inner circular cutting edge. The scrubbing razor may also optionally include a first inner small slide ring 322 slidably disposed within and adjacent to the first inner tubular anchor ring.

The scrubbing razor includes a second intermediate tubular anchor ring 324 with upper holes 326 for mounting screws or bolts, upper slots 327, and lower apertures, as described above, for fastener members, such as interference fit pins or screws. A second tubular anchor ring shim (not shown) may optionally be interposed between the second inner anchor ring and the top cover. The scrubbing razor includes a second intermediate annular blade 330, having apertures 332 for fastener members, such as interference fit pins or screws, and having an outer circular cutting edge 334. Optionally, the second intermediate annular blade may include an inner circular cutting edge. The scrubbing razor may also optionally include a second intermediate slide ring 336 slidably disposed within and adjacent to the second intermediate tubular anchor ring.

Figure 62:
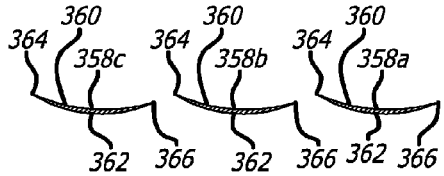
FIG. 62 is a sectional view of a portion of the three annular blades of FIG. 61.
Figure 63:
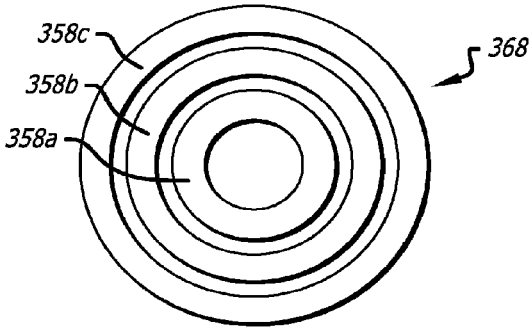
FIG. 63 is a top plan view of the three annular blades of FIG. 61 having a circular shape.
Figure 64:
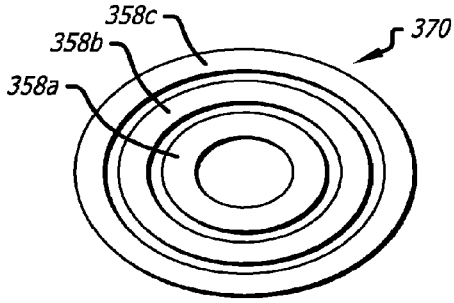
FIG. 64 is a top plan view of the three annular blades of FIG. 61 having an oval shape.
Figure 65:
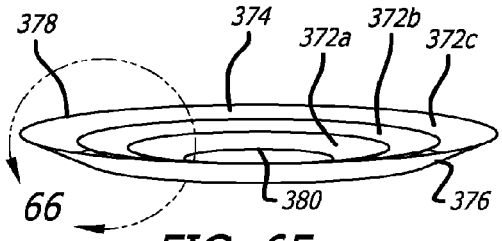
FIG. 65 is a perspective view of another variation of the three annular blades of the third embodiment, each blade having a single or double-edged annular flat rounded configuration.

The scrubbing razor includes a third outer tubular anchor ring 338 with upper holes 340 for mounting screws or bolts, upper slots 341, and lower apertures, as described above, for fastener members, such as interference fit pins or screws. A third outer tubular anchor ring shim (not shown) may optionally be interposed between the second inner anchor ring and the top cover. The scrubbing razor includes a third outer annular blade 344, having apertures 346 for fastener members, such as interference fit pins or screws, and having an outer circular cutting edge 348. Optionally, the third outer annular blade may include an inner circular cutting edge. The scrubbing razor may also optionally include a third outer slide ring 350 slidably disposed within and adjacent to the third outer tubular anchor ring. The first, second and third slide rings are also interposed between the upper surface of the first, second and third cutting blades, respectively, and a spider brace member 352, having a plurality of arms 354 slidably received in the upper slots of the first inner, second intermediate and third outer anchor rings. As is illustrated in FIGS. 61-64, in one variation of the fourth embodiment, the three annular blades each may be formed as single or double-edged annular concave rounded blades 358*a*, 358*b*, 358*c* having a concavely curved upper side surface 360 and a convexly curved bottom side surface 362, as shown in FIG. 62, with a radially outer round cutting edge 364, and may optionally include a radially inner round cutting edge 366. The annular concave rounded blade may be formed to have a substantially circular shape 368 as viewed from the top in FIG. 63, with substantially circular cutting blades, or may be formed to have an oval shape 370 as viewed from the top in FIG. 64, with oval shaped cutting blades.

Figure 66:
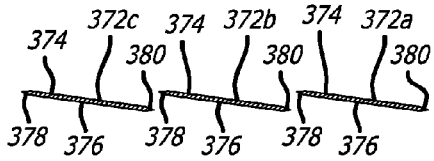
FIG. 66 is a sectional view of a portion of the three annular blades of FIG. 65.
Figure 67:
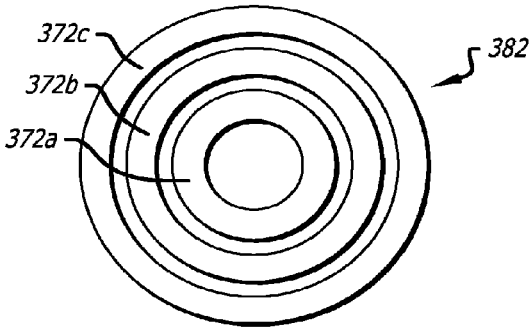
FIG. 67 is a top plan view of the three annular blades of FIG. 65 having a circular shape.
Figure 68:
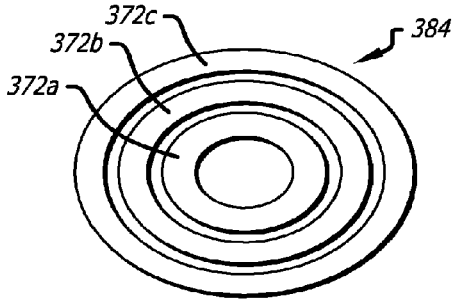
FIG. 68 is a top plan view of the three annular blades of FIG. 65 having an oval shape.
Figure 69:
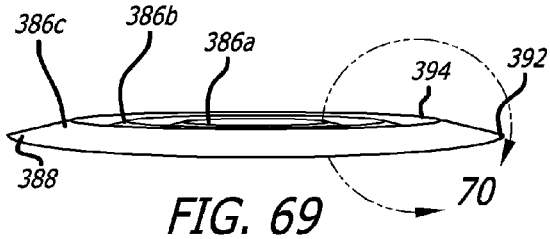
FIG. 69 is a perspective view of another variation of the three annular blades of the third embodiment, each blade having a single-edged annular truncated cone-shaped rounded configuration.
Figure 70:
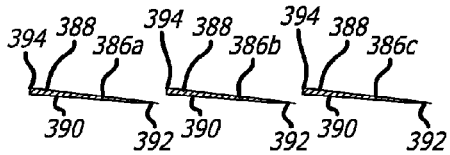
FIG. 70 is a sectional view of a portion of the three annular blades of FIG. 69.
Figure 71:
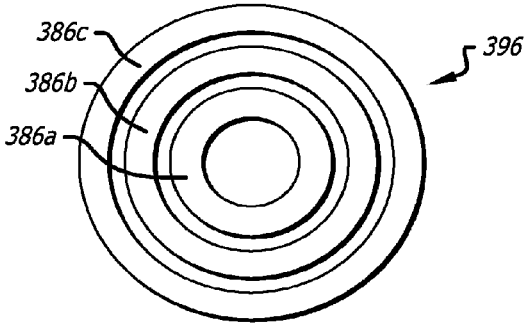
FIG. 71 is a top plan view of the three annular blades of FIG. 69 having a circular shape.
Figure 72:
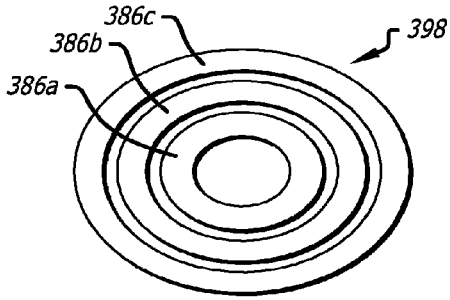
FIG. 72 is a top plan view of the three annular blades of FIG. 69 having an oval shape.
Figure 73:
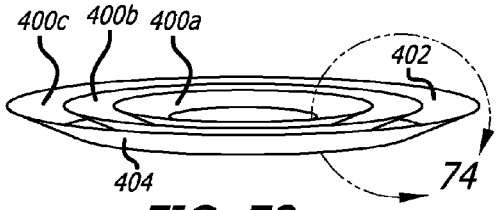
FIG. 73 is a perspective view of another variation of the three annular blades of the third embodiment, each blade having a single-edged annular inverted truncated cone-shaped rounded configuration.
Figure 74:
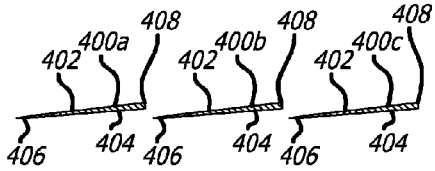
FIG. 74 is a sectional view of a portion of the three annular blades of FIG. 73.
Figure 75:
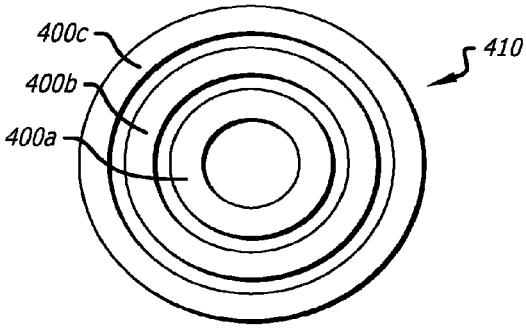
FIG. 75 is a top plan view of the three annular blades of FIG. 73 having a circular shape.
Figure 76:
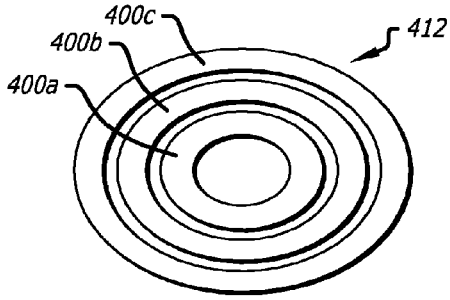
FIG. 76 is a top plan view of the three annular blades of FIG. 73 having an oval shape.

In another variation of the fourth embodiment, illustrated in FIGS. 65-68, the three annular blades each may be formed as single or double-edged annular flat rounded blades 372*a*, 372*b*, 372*c*, having a planar upper side surface 374 and a planar bottom side surface 376, as shown in FIG. 66, with a radially outer rounded cutting edge 378, and may optionally include a radially inner rounded cutting edge 380. The annular flat rounded blade may be formed to have a substantially circular shape 382 as viewed from the top in FIG. 67, with substantially circular cutting edges, or may be formed to have an oval shape 384, as viewed from the top in FIG. 68, with oval cutting edges.

As is illustrated in FIGS. 69-72, in another variation of the fourth embodiment, the three annular blades each may be formed as single-edged annular truncated cone-shaped rounded blades 386*a*, 386*b*, 386*c* having a planar upper side surface 388 and a planar lower side surface 390, with a radially outer rounded downwardly deflected cutting edge 392, and a radially inner rounded, upwardly deflected edge 394. The annular truncated cone-shaped rounded blade may be formed to have a substantially circular shape 396 as viewed from the top in FIG. 71, with a substantially circular radially outer cutting edge, or may be formed to have an oval shape 398, as viewed from the top in FIG. 72, with an oval radially outer cutting edge.

As is illustrated in FIGS. 73-76, in another variation of the fourth embodiment, the three annular blades each may be formed as single-edged annular inverted truncated cone-shaped rounded blades 400*a*, 400*b*, 400*c* having a planar upper side surface 402 and a planar lower side surface 404, with a radially inner rounded, downwardly deflected cutting edge 406, and a radially outer rounded, upwardly deflected edge 408. The annular inverted truncated cone-shaped rounded blade may be formed to have a substantially circular shape 410 as viewed from the top in FIG. 75, with a substantially circular radially inner cutting edge, or may be formed to have an oval shape 412, as viewed from the top in FIG. 76, with an oval radially inner cutting edge.

Figure 77:
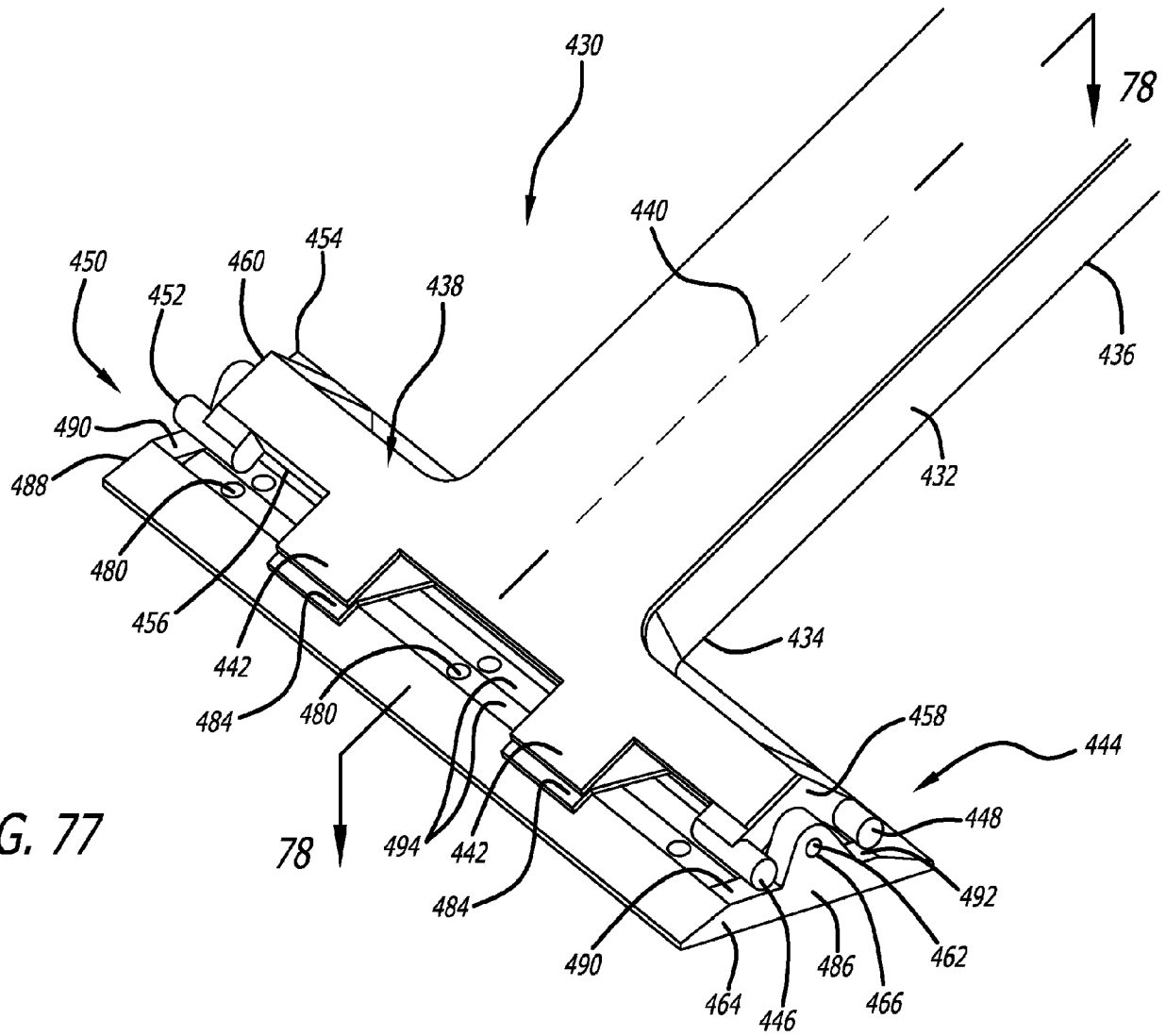
FIG. 77 is an enlarged top perspective view of a fifth preferred embodiment of the scrubbing razor utilizing straight blades with opposing cutting edges defining a single plane, according to the invention.

With reference to FIGS. 77-81, in a fifth preferred embodiment, the present invention provides for a bidirectional scrubbing razor 430 including a handle 432, typically a straight handle, for example, having a forward end 434 and a rearward end 436, and having an elongated head 438 extending substantially perpendicular to a longitudinal axis 440 of the handle at the forward end of the handle and typically fixedly and integrally joined thereto. The elongated head preferably includes a plurality of forwardly extending spring tabs 442, a left side pair 444 of rotation limiting posts, including forward and rearward rotation limiting posts 446, 448, and a right side pair 450 of rotation limiting posts, including forward and rearward rotation limiting posts 452, 454. The rotation limiting posts are typically cylindrical posts mounted to or integrally formed in an underside 456 of the elongated head at the left and right sides 458, 460, respectively. Left and right side pivot pins, only the left one 462 of which is visible in FIG. 77, are also provided on the left and right sides of the elongated head, typically located approximately between the left and right side pairs of rotation limiting posts, respectively. The elongated head also includes a blade mounting portion 464, which is typically pivotally mounted to the left and right side pivot pins which are received in left and right apertures, only the left one 466 of which is visible in FIG. 77.

Figure 78:
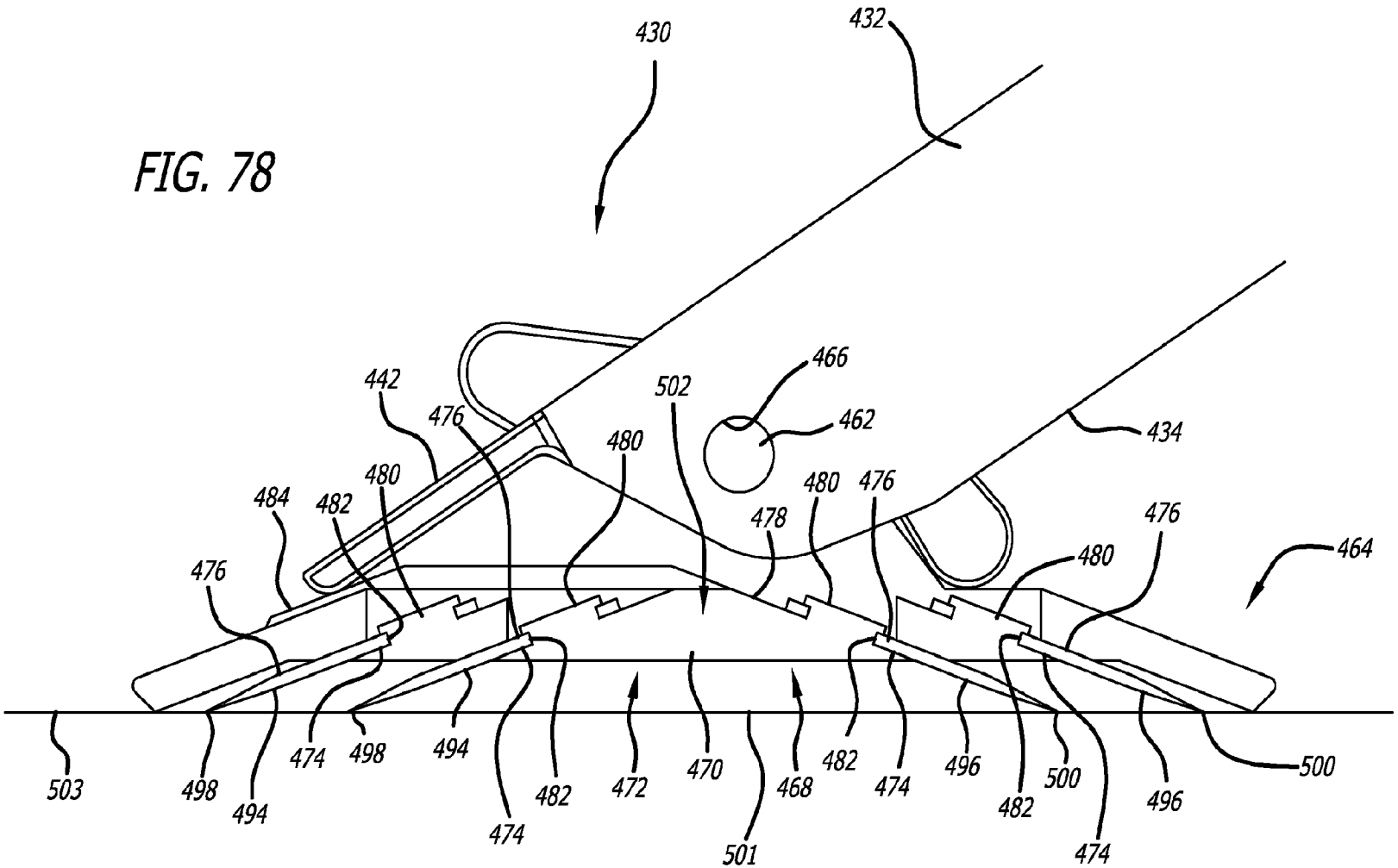
FIG. 78 is a sectional view of the scrubbing razor taken along line 78-78 of FIG. 77, showing straight blades with outwardly facing opposing cutting edges defining a single plane.
Figure 79:
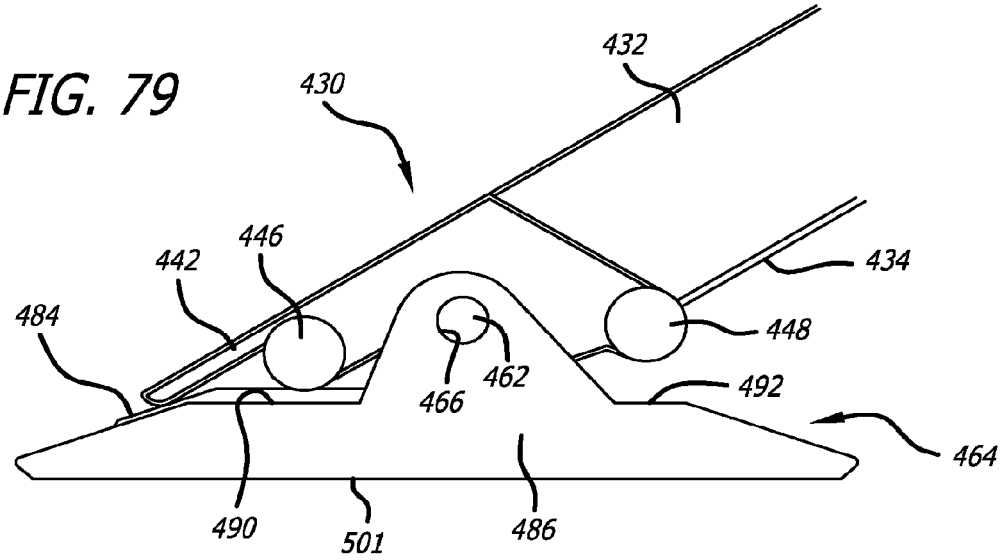
FIG. 79 is a side elevational view of the scrubbing razor similar to FIG. 78, showing the handle in a lowered position.
Figure 80:
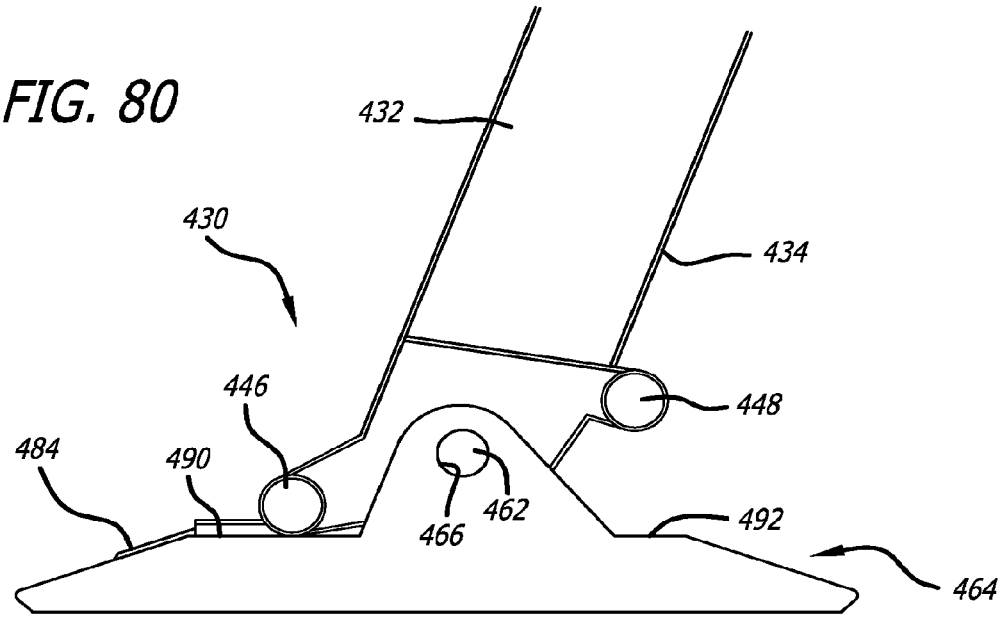
FIG. 80 is a side elevational view of the scrubbing razor similar to FIG. 78, showing the handle in a raised position.

As is illustrated in FIG. 78, the blade mounting portion includes an underside 468 with a bottom wall 470 defining a recess 472, and a plurality of slots 474 through which a plurality of straight blades 476 extend on the underside of the blade mounting portion. The plurality of straight blades are typically held in place, such as in notches formed on an upper side 478 of the blade mounting portion, by a plurality of posts 480 received through and engaged in corresponding apertures 482 in the straight blades. The upper side of the blade mounting portion also typically includes a plurality of elongated ramps 484 at locations on the upper side of the blade mounting portion underneath and corresponding to the locations of the forwardly extending spring tabs of the elongated head, providing upper surfaces against which the forwardly extending spring tabs can react. The left and right sides 486, 488 of the blade mounting portion have a surface defining forward and rearward shoulder surfaces 490, 492, against which the forward and rearward rotation limiting posts can also react, to limit the rotation of the handle with respect to the blade mounting portion of the elongated head. The handle, elongated head and blade mounting portion can be formed of any suitable plastic material, such as molded thermoplastic, for example. Referring to FIGS. 77 and 78, in a presently preferred aspect, the blade mounting portion includes one or more forward straight blades 494 and one or more rearward straight blades 496 mounted to and extending from the underside of the blade mounting portion.

As is illustrated in FIG. 78, in one preferred aspect, the cutting edges 498 of the one or more forward straight blades and the cutting edges 500 of the one or more rearward straight blades face obliquely outwardly from a middle portion 502 of the blade mounting portion, and the cutting edges of the one or more forward straight blades face obliquely away from the opposing cutting edges of the one or more rearward straight blades. In another preferred aspect, the blade mounting portion underside has a lower face 501 and the lower face 501, and the cutting edges of the one or more forward straight blades and the opposing cutting edges of the one or more rearward straight blades cutting edges substantially define a single common cutting plane 503.

Figure 81:
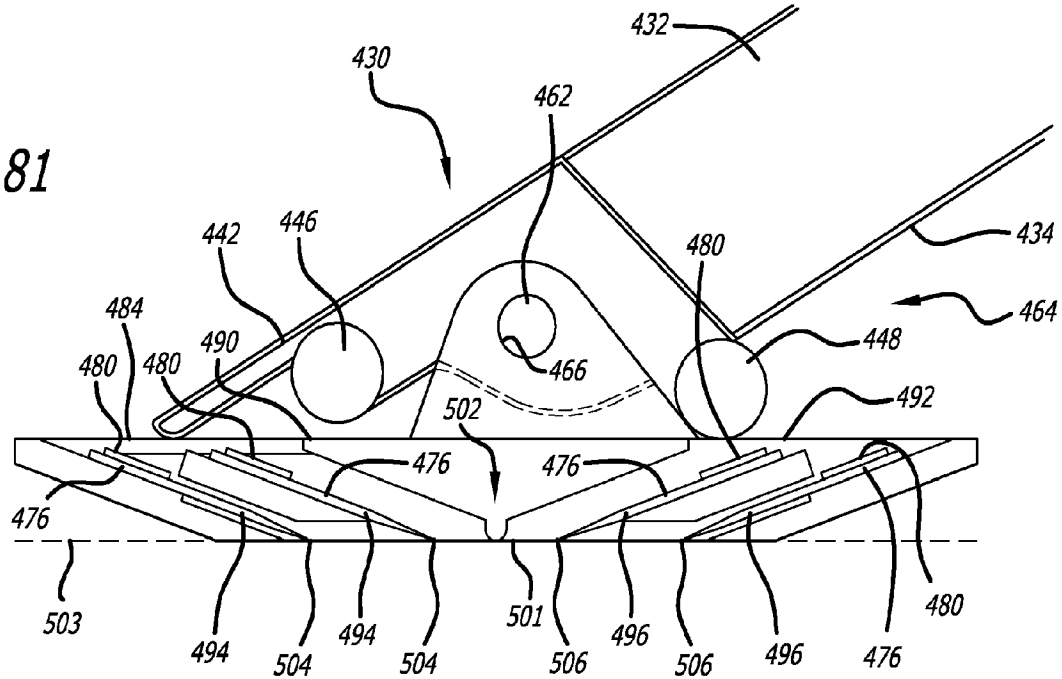
FIG. 81 is a sectional view of a variation of the scrubbing razor of FIG. 77 similar to FIG. 78, with straight blades with inwardly facing opposing cutting edges defining a single plane, and showing the handle in a lowered position.

Referring to FIG. 81, in one preferred variation, the cutting edges 504 of the one or more forward straight blades and the cutting edges 506 of the one or more rearward straight blades face obliquely inwardly toward the middle portion 502 of the blade mounting portion, and the cutting edges of the one or more forward straight blades face obliquely toward the opposing cutting edges of the one or more rearward straight blades. In another preferred aspect, the blade mounting portion underside has a lower face 501; and the lower face with the cutting edges of the one or more forward straight blades and the opposing cutting edges of the one or more rearward straight blades substantially define a single common cutting plane.

Figure 82:
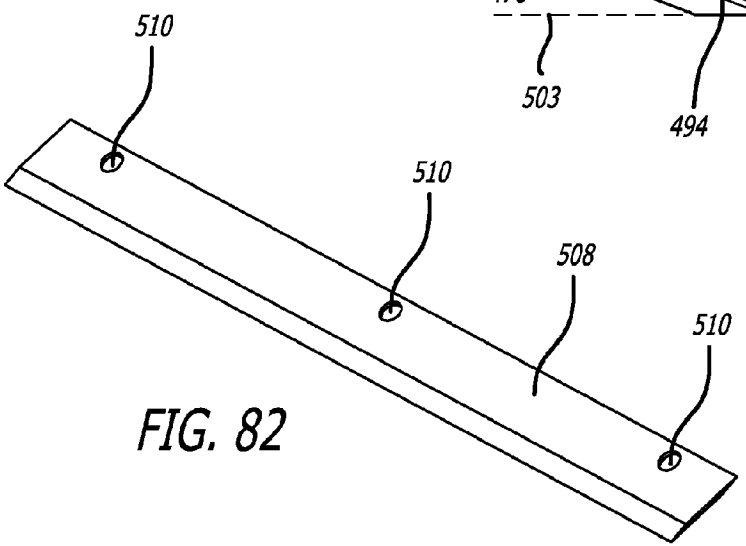
FIG. 82 is a top perspective view of a straight blade of the scrubbing razor of FIG. 77 or FIG. 81 according to the invention.
Figure 83:
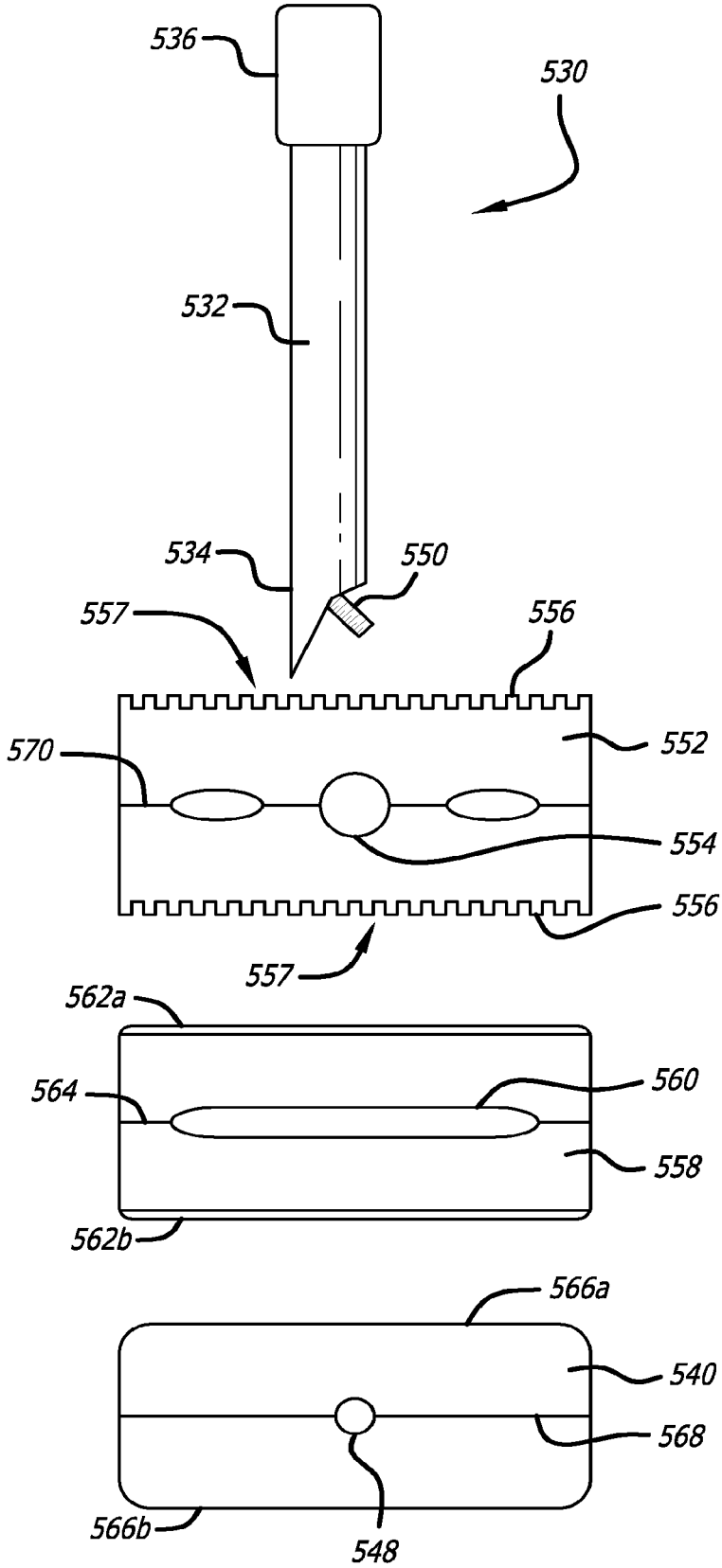
FIG. 83 is an exploded view of a variation of the bi-directional scrubbing razor utilizing one or more double edge blades extending at an oblique angle from a middle portion.
Figure 84:
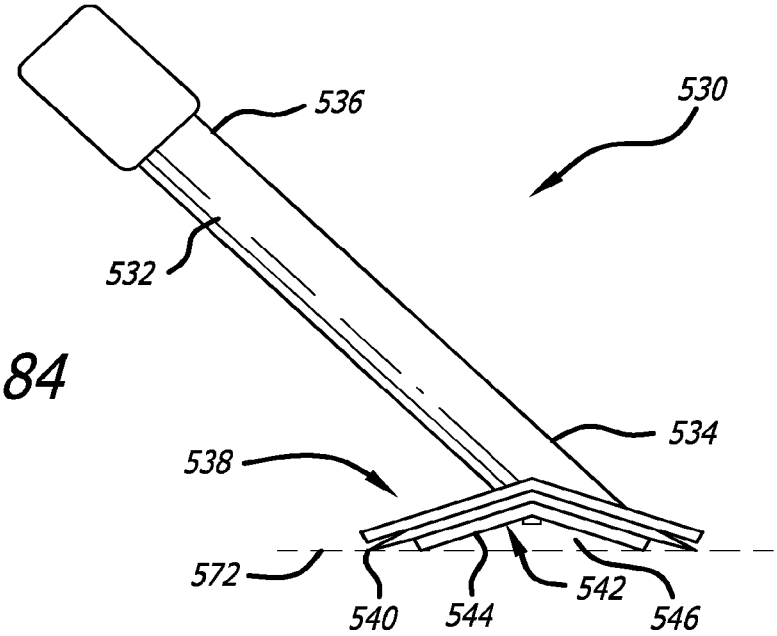
FIG. 84 is a side elevational view of the bi-directional scrubbing razor of FIG. 83.
Figure 85:
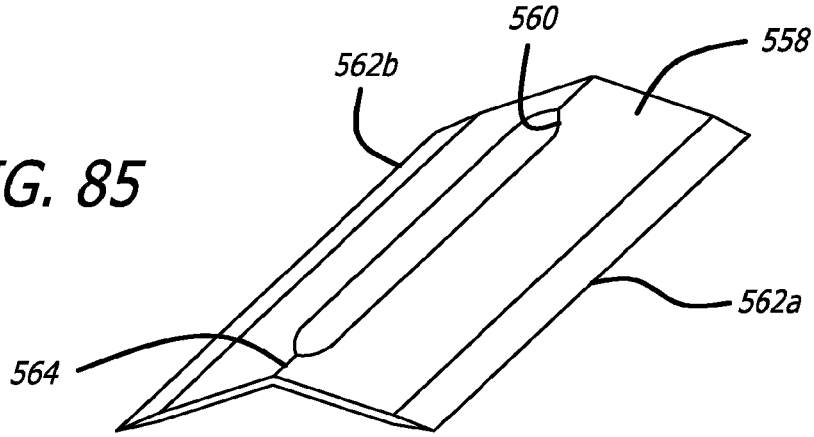
FIG. 85 is a perspective view of a double edge blade of the scrubbing razor of FIG. 83.

As is illustrated in FIG. 82, each straight blade 508 typically is formed of conventional, single edge razor blades that can be mounted in the blade mounting portion such as during molding of the blade mounting portion, or that can be separately formed and mounted to the blade mounting portion, such as by attaching the blades in notches formed in an upper side of the blade mounting portion, and a plurality of posts received through and engaged in corresponding apertures 510 in the straight blades, as described above, or adhesively or other suitable mechanical fastening means.

A variation of the fifth preferred embodiment is illustrated in 83-86, showing a bi-directional scrubbing razor 530 including a handle 532, typically a straight handle, for example, having a forward end 534 and rearward end 536. An elongated head 538 is affixed to the forward end of the handle and typically extends at an oblique angle from the forward end of the handle. The head includes a blade mounting portion or lower cap 540 having an underside 542 with a bottom wall 544 defining a recess 546, and a slot or aperture 548 for receiving a coupling member 550 or other attachment means at the forward end of the handle for affixing the blade mounting portion or lower cap to the handle. An upper blade guard 552 may also be provided to form an upper portion of the blade mounting portion in combination with the lower cap of the blade mounting portion. The blade guard also preferably includes a generally central slot or aperture 554 for receiving the coupling member and fitting to the forward end of the handle, being captured on the forward end of the handle by the lower cap. The blade guard may also be provided with a plurality of notches or teeth 556 along opposing lateral edges 557 of the blade guard.

Figure 86:
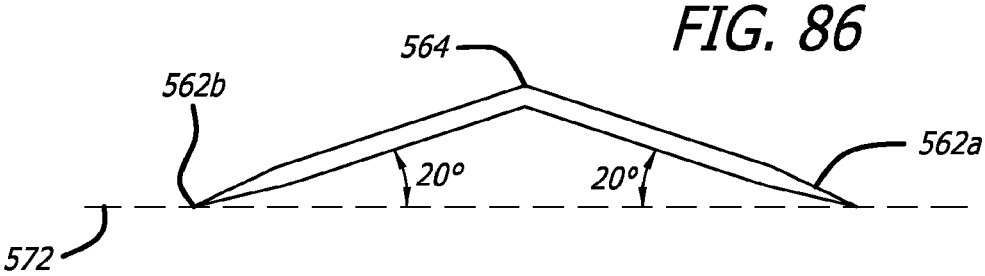
FIG. 86 is an end view of the double edge blade of FIG. 85.

One or more double edge cutting blades 558 are preferably captured between the lower cap and the upper blade guard, and with each double edge blade having a generally central slot or aperture 560 for also receiving the coupling member at the forward end of the handle, so as to allow the double edge cutting blade to be captured between the upper blade guard and the lower cap. Each double edge cutting blade includes a first lateral cutting edge 562*a* and a second lateral cutting edge 562*b* opposing the first lateral cutting edge, with the first and second lateral cutting edges facing obliquely outward from a middle portion 564. The lower cap also similarly includes a first lateral edge 566*a* and a second lateral edge 566*b* extending outward from a middle portion 568, and the upper blade guard similarly has a middle portion 570 from which the lateral opposing edges 557 extend at an oblique angle with respect to the middle portion. As is illustrated in FIG. 86, the opposing cutting edges of the double edge blade extending obliquely from the middle portion of the blade typically form a cutting angle of approximately 20 degrees with respect to a single common cutting plane 572 substantially defined by the opposing lateral edges of the double edge blade and the opposing lateral edges of the lower cap forming a lower face of the underside of the blade mounting portion. The opposing lateral edges of the lower cap and the upper blade guard typically extend at an angle from their respective middle portions similar to the cutting angle of the double edge blade.

It will be apparent from the foregoing that while particular forms of the invention have been illustrated and described, various modifications can be made without departing from the spirit and scope of the invention. Accordingly, it is not intended that the invention be limited, except as by the appended claims.

What is claimed is:

1. A bidirectional scrubbing razor, comprising:

a handle having a forward end, a rearward end, and an elongated head extending substantially perpendicular to a longitudinal axis of the handle at the forward end of the handle, the elongated head, said elongated head including a plurality of spring tabs;

a blade mounting portion pivotally mounted to said elongated head for pivotal motion of said blade mounting portion relative to said elongated head between forwardly rotated and rearwardly rotated positions, said blade mounting portion having an upper side and an underside, and said upper side of said blade mounting portion including a plurality of elongated ramps having surfaces configured to engage said plurality of spring tabs; and at least one straight blade providing opposing cutting edges extending at oblique angles with respect to said blade mounting portion, said opposing cutting edges and said underside of said blade mounting portion substantially defining a single common cutting plane.

2. The bidirectional scrubbing razor of claim 1, wherein said at least one straight blade comprises:

at least one forward straight blade mounted to and extending from the underside of the blade mounting portion, and at least one rearward straight blade mounted to and extending from the underside of the blade mounting portion in opposing relation to said at least one forward straight blade, the at least one forward straight blade having a cutting edge, and the at least one rearward straight blade having a cutting edge in opposing relation to said cutting edge of said at least one forward straight blade, the cutting edge of said at least one forward straight blade and the opposing cutting edge of said at least one rearward straight blade substantially defining said single common cutting plane.

3. The bidirectional scrubbing razor of claim 2, wherein said cutting edges of said at least one forward straight blade and said at least one rearward straight blade face obliquely outwardly from a middle portion of the blade mounting portion.

4. The bidirectional scrubbing razor of claim 2, wherein said cutting edges of said at least one forward straight blade face obliquely away from said cutting edges of said one or more rearward straight blades.

5. The bidirectional scrubbing razor of claim 2, wherein said cutting edges of said at least one forward straight blade and said at least one rearward straight blade face obliquely inwardly toward a middle portion of the blade mounting portion.

6. The bidirectional scrubbing razor of claim 2, wherein said cutting edges of said at least one forward straight blade face obliquely toward said opposing cutting edges of said at least one rearward straight blade.

7. The bidirectional scrubbing razor of claim 1, wherein said at least one straight blade comprises a double edge blade having opposing lateral cutting edges extending at an oblique angle from a middle portion of the double edge blade, said opposing lateral cutting edges extending from the underside of the blade mounting portion, and the opposing lateral cutting edges of said at least one double edge blade substantially defining said single common cutting plane.

8. The bidirectional scrubbing razor of claim 1, wherein said elongated head includes a forward rotation limiting post and a rearward rotation limiting post, and said blade mounting portion includes a forward shoulder surface and a rearward shoulder surface configured to engage said forward and rearward rotation limiting posts, respectively.

* * * * *